US008333853B2

(12) United States Patent
Giummarra et al.

(10) Patent No.: US 8,333,853 B2
(45) Date of Patent: Dec. 18, 2012

(54) AGING OF ALUMINUM ALLOYS FOR IMPROVED COMBINATION OF FATIGUE PERFORMANCE AND STRENGTH

(75) Inventors: Cindie Giummarra, Pittsburgh, PA (US); Roberto J. Rioja, Murrysville, PA (US); Gary H. Bray, Murrysville, PA (US); Paul E. Magnusen, Pittsburgh, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 12/355,515

(22) Filed: Jan. 16, 2009

(65) Prior Publication Data

US 2010/0180992 A1 Jul. 22, 2010

(51) Int. Cl.
*C22F 1/04* (2006.01)
*C22F 1/057* (2006.01)

(52) U.S. Cl. ..... 148/700; 147/698; 147/699; 147/702

(58) Field of Classification Search ..... 148/688, 148/698–702
See application file for complete search history.

(56) References Cited

U.S. PATENT DOCUMENTS

| | | | | |
|---|---|---|---|---|
| 4,292,079 | A | 9/1981 | Pickens et al. | 75/232 |
| 4,297,136 | A | 10/1981 | Pickens et al. | 419/11 |
| 4,532,106 | A | 7/1985 | Pickens | 420/528 |
| 4,626,409 | A | 12/1986 | Miller | 420/533 |
| 4,758,286 | A | 7/1988 | Dubost et al. | 148/12.7 |
| 4,816,087 | A | 3/1989 | Cho | 148/2 |
| 4,832,910 | A | 5/1989 | Rioja et al. | 420/528 |
| 4,840,682 | A | 6/1989 | Curtis et al. | 148/12.7 |
| 4,861,391 | A | 8/1989 | Rioja et al. | 148/564 |
| 4,869,870 | A | 9/1989 | Rioja et al. | 420/532 |
| 4,897,125 | A | 1/1990 | Dubost et al. | 148/12.7 |
| 4,927,469 | A | 5/1990 | Rioja et al. | 148/514 |
| 4,927,470 | A | 5/1990 | Cho | 148/694 |
| 4,946,517 | A | 8/1990 | Cho | 148/693 |
| 4,961,792 | A | 10/1990 | Rioja et al. | 148/552 |
| 4,988,394 | A | 1/1991 | Cho | 148/693 |
| 4,999,061 | A | 3/1991 | Curtis et al. | 148/12.7 |
| 5,032,359 | A | 7/1991 | Pickens et al. | 420/533 |
| 5,066,342 | A | 11/1991 | Rioja et al. | 148/693 |
| 5,076,859 | A | 12/1991 | Rioja et al. | 148/698 |
| 5,108,519 | A | 4/1992 | Armanie et al. | 148/689 |
| 5,122,339 | A | 6/1992 | Pickens et al. | 420/533 |

(Continued)

FOREIGN PATENT DOCUMENTS

CA 1291927 11/1991

(Continued)

OTHER PUBLICATIONS

Balmuth, E.S., et al., "Fracture and Fatigue Crack Growth Resistance of Recrystallized Al-Li Alloys," *Materials Science Forum*, 217-222:1365-1370 (1996).

(Continued)

*Primary Examiner* — John Sheehan
*Assistant Examiner* — Brian Walck
(74) *Attorney, Agent, or Firm* — Greenberg Traurig, LLP

(57) ABSTRACT

Aluminum alloy having an improved combination of properties are provided. In one aspect, a method for producing the alloy includes preparing an aluminum alloy for artificial aging and artificially aging the alloy. In one embodiment, the artificially aging step includes aging the aluminum alloy at a temperature of at least about 250° F., and final aging the aluminum alloy at a temperature of not greater than about 225° F. and for at least about 20 hours. These aluminum alloys realize an improved combination of properties, including improved strength with at least equivalent fatigue crack growth resistance.

14 Claims, 21 Drawing Sheets

U.S. PATENT DOCUMENTS

| | | | | |
|---|---|---|---|---|
| 5,133,931 | A | 7/1992 | Cho | 420/541 |
| 5,135,713 | A | 8/1992 | Rioja et al. | 420/532 |
| 5,137,686 | A | 8/1992 | Rioja et al. | 420/528 |
| 5,151,136 | A | 9/1992 | Witters et al. | 148/689 |
| 5,198,045 | A | 3/1993 | Cho | 148/552 |
| 5,211,910 | A | 5/1993 | Pickens et al. | 420/532 |
| 5,213,639 | A | 5/1993 | Colvin et al. | 148/693 |
| 5,259,897 | A | 11/1993 | Pickens et al. | 148/417 |
| 5,277,719 | A | 1/1994 | Kuhlman et al. | 148/694 |
| 5,383,986 | A | 1/1995 | Cho | 148/697 |
| 5,389,165 | A | 2/1995 | Cho | 148/552 |
| 5,393,357 | A | 2/1995 | Cho | 148/437 |
| 5,431,876 | A | 7/1995 | Kumar et al. | 420/529 |
| 5,455,003 | A | 10/1995 | Pickens et al. | 420/529 |
| 5,462,712 | A | 10/1995 | Langan et al. | 420/528 |
| 5,863,359 | A | 1/1999 | Karabin et al. | 148/437 |
| 5,865,911 | A | 2/1999 | Miyasato et al. | 148/439 |
| 5,879,481 | A | 3/1999 | Price | 148/698 |
| 6,113,711 | A | 9/2000 | Armanie et al. | 148/689 |
| 6,325,869 | B1 | 12/2001 | Liu et al. | 148/439 |
| 6,395,111 | B1 | 5/2002 | Pfannenmuller et al. | 148/698 |
| 6,444,058 | B1 | 9/2002 | Liu et al. | 148/439 |
| 6,537,392 | B2 | 3/2003 | Magnusen et al. | 148/417 |
| 6,562,154 | B1 | 5/2003 | Rioja et al. | 148/415 |
| 6,569,271 | B2 | 5/2003 | Cho | 148/701 |
| 6,613,167 | B2 | 9/2003 | Magnusen et al. | 148/693 |
| 6,869,490 | B2 | 3/2005 | Cho | 148/698 |
| 6,918,975 | B2 | 7/2005 | Liu et al. | 148/690 |
| 7,037,391 | B2 | 5/2006 | Lumley et al. | 148/698 |
| 7,097,719 | B2 | 8/2006 | Bray et al. | 148/417 |
| 7,125,459 | B2 | 10/2006 | Cho | 148/698 |
| 7,229,508 | B2 | 6/2007 | Cho et al. | 148/417 |
| 7,229,509 | B2 | 6/2007 | Cho | 148/417 |
| 2002/0015658 | A1 | 2/2002 | Rioja et al. | 420/532 |
| 2002/0056493 | A1 | 5/2002 | Pfannenmuller et al. | 148/702 |
| 2003/0226935 | A1 | 12/2003 | Garratt et al. | 244/123 |
| 2004/0071586 | A1 | 4/2004 | Rioja et al. | 420/532 |
| 2006/0011272 | A1 | 1/2006 | Lin et al. | 148/439 |
| 2008/0029187 | A1 | 2/2008 | Lin et al. | 148/417 |
| 2008/0056932 | A1 | 3/2008 | Cho et al. | 420/541 |
| 2008/0283163 | A1 | 11/2008 | Bray et al. | 148/690 |
| 2009/0084474 | A1 | 4/2009 | Cheong et al. | 148/693 |

FOREIGN PATENT DOCUMENTS

| | | |
|---|---|---|
| EP | 0273600 | 7/1988 |
| GB | 2121822 | 1/1984 |
| UA | 66367 | 5/2004 |
| WO | WO 89/01531 | 2/1989 |
| WO | WO 90/02211 | 3/1990 |
| WO | WO 91/11540 | 8/1991 |

OTHER PUBLICATIONS

Baumann, S.F., et al., "The Effect of Ternary Additions on the δ'/α Misfit and the δ' Solvus Line in Al-Li Alloys," *Proc. 2nd International Aluminum-Lithium Conference sponsored by the Nonferrous Metals Committee of the Metallurgical Society of AIME*, Monterey, California, Apr. 12-14, 1983, pp. 17-29.

Chester, R. J., et al., "Precipitation in Al-Cu-Mg-Ag Alloys," *The Metallurgy of Light Alloys*, pp. 75-81 (Mar. 1983).

Gayle, F. W., et al., "Alloying Additions and Property Modification in Aluminum-Lithium—X Systems," *Proc. 1st International Aluminum-Lithium Conference sponsored by the TMS-AIME Nonferrous Metals Committee*, Stone Mountain, Georgia, May 19-21, 1980, pp. 120-139.

Hayashi, N., et al., "Aging Phenomenon of Al-Li-Mg Alloy Affected by Additional Elements," *Journal of Japan Institute of Light Metals*, 32(7):350-355 (Jul. 1982). (English translation included).

Kojima, Y., et al. "Effect of Lithium Addition on the Elevated Temperature Properties of 2219 Alloy," *Journal of Japan Institute of Light Metals*, 36(11):737-743, (Nov. 1986). (English translation included).

Marchive, D., et al., "Processing and Properties of 2091 and 8090 Forgings," *Proc. 4th International Aluminium Lithium Conference*, Paris, France, Jun. 10-12, 1987, pp. C3-43-48.

Mondolfo, L.F., "*Aluminum alloys: Structure and Properties*," (Butterworth & Co (Publishers) Ltd) (1st ed., 1976), pp. 502, 641, 693-725.

Polmear, I. J. "The Effects of Small Additions of Silver on the Aging of Some Aluminum Alloys," *Transactions of the Metallurgical Society of AIME*, 230:1331-1339 (Oct. 1964).

Polmear, I. J. "Development of an Experimental Wrought Aluminium Alloy for Use at Elevated Temperatures," *Aluminum Alloys—Physical and Mechanical Properties*, pp. 661-674, 1986.

Polmear, I. J., et al., "Design and Development of an Experimental Wrought Aluminum Alloy for Use at Elevated Temperatures," *Metallurgical Transactions A*, 19A:1027-1035 (Apr. 1988).

Reynolds, A. P., et al., "The Effect of Thermal Exposure on the Fracture Behavior of Aluminum Alloys Intended for Elevated Temperature Service," *Elevated Temperature Effects on Fatigue and Fracture, ASTM STP 1297*, pp. 191-205 (1997).

Sen, N., et al., "The Effect of an Addition of 0-5 wt.-% Silver on the Ageing Characteristics of Certain Al-Cu-Mg Alloys," *The Mechanism of Phase Transformations in Crystalline Solids*, Monograph and Report Series No. 33 (The Institute of Metals), pp. 49-53 (1969).

Speidel, M. O., et al., "Development of High-Strength Aluminum Alloys," *Proc. 6th International Conference on Light Metals*, Leoben/Vienna, 1975, pp. 67-69.

Speidel, M. O., "Stress Corrosion Cracking of Aluminum Alloys," *Metallurgical Transactions A*, 6A:631-651 (Apr. 1975).

Vietz, J. T., et al. "The Influence of Small Additions of Silver on the Ageing of Aluminium Alloys: Observations on Al-Cu-Mg Alloys," *Journal of the Institute of Metals*, 94:410-419 (1966).

Wang, W. et al., "Lithium-Containing 2024 Aluminum Alloys Made From Rapidly-Solidified Powders," *Proc. of the 2nd International Aluminum-Lithium Conference sponsored by the Nonferrous Metals Committee of the Metallurgical Society of AIME*, Monterey, California, Apr. 12-14, 1983, pp. 447-467.

McDarmaid, D. S., et al. "Effect of Natural Aging on the Tensile Properties of the Al-Li Alloys 8090, 8091 and 2091", *Materials Science and Engineering A*, vol. 101, pp. 193-200, May 1, 1988.

Romios, M., et al. "Design of Multistep Aging Treatments of 2099 (C458) Al-Li Alloy", Journal of Materials Engineering and Performance, ASM International, Materials Park, OH, US, vol. 14, No. 5, pp. 641-646, Oct. 1, 2005.

International Search Report and Written Opinion from corresponding International Application No. PCT/US2009/068998, mailed Apr. 7, 2010.

Giummarra, C., et al., "Al-Li Alloys: Development of Corrosion Resistant, High Toughness Aluminum-Lithium Aerospace Alloys," *Proceedings of the 11th Conference on Aluminium Alloys* 1:176-188, Sep. 22-26, 2008.

Giummarra, C, et al., "New Aluminum Lithium Alloys for Aerospace Applications," *Proceedings of the 3rd International Conference on Light Metals Technology*, pp. 24-27, Sep. 2007.

Rioja, R. J., et al., "The Role of Crystallographic Texture on the Performance of Flat Rolled Aluminum Products for Aerospace Applications," *TMS, Light Metals*, pp. 1065-1069, 2008.

Warren, C. J., et al., "Forming Characteristics and Post-Formed Properties of Al-Li Alloys," Aluminum-Lithium Alloys, Al-Li Alloys V, pp. 417-429, Ed. Sander TH, Starke EA, 1989.

Registration Record Series Teal Sheets, *International Alloy Designations and Chemical Composition Limits for Wrought Aluminum and Wrought Aluminum Alloys*, The Aluminum Association, pp. 1-27, Feb. 2009.

2199-T8 Sheet, T-L Direction

| Specimen ID | Direction | Age Practice | Yield Strength (ksi) | Yield Strength (MPa) | Tensile Strength (ksi) | Tensile Strength (MPa) | Elongation (%) |
|---|---|---|---|---|---|---|---|
| 843968 | L | 1 Step | 48.1 | 332 | 58.5 | 403 | 18.0 |
| 843968 | LT | 1 Step | 44.7 | 308 | 60.8 | 419 | 16.0 |
| 843969 | L | 2 Step | 52.6 | 363 | 62.2 | 429 | 15.3 |
| 843969 | LT | 2 Step | 50.3 | 347 | 65.2 | 450 | 13.3 |

| Specimen ID | Direction | Age Practice | Yield Strength (ksi) | Yield Strength (MPa) | Tensile Strength (ksi) | Tensile Strength (MPa) | Elongation (%) |
|---|---|---|---|---|---|---|---|
| 843968 | L | 1 Step | 48.1 | 332 | 58.5 | 403 | 18.0 |
| 843968 | LT | 1 Step | 44.7 | 308 | 60.8 | 419 | 16.0 |
| 843969 | L | 2 Step | 52.6 | 363 | 62.2 | 429 | 15.3 |
| 843969 | LT | 2 Step | 50.3 | 347 | 65.2 | 450 | 13.3 |

DF <100>ZA 1/2 of (020)

DF <100>ZA 1/2 of (020)

DF <100>ZA 1/2 of (020)

DF <100>ZA 1/2 of (020)

AGING OF ALUMINUM ALLOYS FOR IMPROVED COMBINATION OF FATIGUE PERFORMANCE AND STRENGTH

BACKGROUND

For aluminum alloys, it is generally accepted that fatigue crack growth resistance under spectrum loading generally decreases as strength increases, and vice-versa. See, e.g., Wanhill et al., "Flight simulation and constant amplitude fatigue crack growth in aluminum-lithium sheet and plate", International Congress on Aeronautical Fatigue, Tokyo, Japan, 1991. Additionally, some 7xxx alloys, such as AA7150 or AA7055, realize higher strengths than 2xxx alloys, such as AA2024, AA2026 and AA2099, but also realize significantly lower fatigue crack growth resistance.

BRIEF SUMMARY OF THE DISCLOSURE

Aluminum alloys having an improved combination of properties are disclosed. In one aspect, a method of producing an aluminum alloy is disclosed. The method includes the steps of (i) preparing a first aluminum alloy for artificial aging, and (ii) artificially aging the first aluminum alloy. In one approach, the preparing step (i) includes (a) solution heat treating an alloy comprising at least 0.1 wt. % Li at a temperature of at least 800° F. and (b) quenching the alloy. The method may optionally include the step of cold deforming the alloy.

In one approach, the artificial aging step (ii) includes at least two artificial aging steps, one of those steps including (c) aging the first aluminum alloy at a temperature of at about least 250° F., and the last of those steps (i.e., the final artificial aging step) including (d) aging the first aluminum alloy at a temperature of not greater than about 225° F. and for at least about 20 hours. Other steps, known to those skilled in the art, may be used as part of the preparing or artificial aging steps.

In one embodiment, the lower limit of the final artificial aging step (ii)(d) is at least about 150° F. In other embodiments, the lower limit of the final artificial aging step (ii)(d) is at least about 160° F., or at least about 165° F., or at least about 170° F., or at least about 175° F. In one embodiment, the upper limit of the final artificial aging step (ii)(d) is not greater than about 220° F. In other embodiments, the lower limit of the final artificial aging step (ii)(d) is not greater than about 215° F., or not greater than about 210° F., or not greater than about 205° F., or not greater than about 200° F. In one embodiment, the final aging step (ii)(2) is completed at a temperature that is lower than any previous artificial aging step. In one embodiment, the duration of the final aging step (ii)(d) is not greater than about 5,000 hours. In other embodiments, the duration of the final aging step (ii)(d) is not greater than about 2,000 hours, such as not greater than about 1,000 hours, or not greater than about 500 hours, or even not greater than about 150 hours or about 100 hours.

Aluminum alloys produced in accordance with this methodology, and in particular the final aging step, may realize an improved combination of strength and fatigue crack growth resistance as compared to other aluminum alloys that are not finally aged as described herein. In one approach, a first aluminum alloy may realize, or is composed of, the following properties: (1) at least about a 6% increase in tensile yield strength as compared to a similar aluminum alloy; and (2) at least equal fatigue crack growth resistance as compared to the similar aluminum alloy. In some embodiments, the increase in strength is at least about an 8% increase, or at least about a 10% increase, or at least about a 12% increase, and with at least equal fatigue crack growth performance.

As used herein, "tensile yield strength" means the engineering stress at which material strain is considered to change from elastic to plastic deformation, beyond which the material is deformed permanently. For aluminum alloys, and for purposes of this patent application, tensile yield strength is measured at an offset strain of 0.2% in accordance with ASTM B557-06.

As described above, a "first aluminum alloy" is an aluminum alloy prepared and artificially aged, as claimed. The aluminum alloy is generally a wrought aluminum alloy, but could be another aluminum alloy form, such as a casting aluminum alloy.

A "similar aluminum alloy" is an aluminum alloy product having an identical composition to the first aluminum alloy, and is prepared identically for artificial aging as the first aluminum alloy. The similar aluminum alloy product is artificially aged in the same fashion as the first aluminum alloy with respect to all aging steps, except the final aging step, where the similar aluminum alloy is artificially aged either (i) at a temperature of greater than 225° F. or (ii) at a temperature of not greater than 225° F. but for less than 20 hours.

As noted above, the first aluminum alloy and the similar aluminum alloy may have an identical composition. For the purposes of this patent application, an "identical composition" and the like means that the first aluminum alloy and the similar aluminum alloy have compositions that are within standard tolerances of one another. For example, for AA2199, a first aluminum alloy may comprise 2.8 wt. % Cu, 1.5 wt. % Li, 0.2 wt. % Mn, 0.2 wt. % Mg, 0.4 wt. % Zn, 0.03 wt. % Ti, 0.09 wt. % Zr, 0.03 wt. % Si, and 0.05 wt. % Fe, the balance being aluminum and trace impurities. A second aluminum alloy may comprise 2.6 wt. % Cu, 1.6 wt. % Li, 0.25 wt. % Mn, 0.3 wt. % Mg, 0.4 wt. % Zn, 0.06 wt. % Ti, 0.10 wt. % Zr, 0.04 wt. % Si, and 0.06 wt. % Fe, the balance being aluminum and trace impurities. These first and second aluminum alloys would be considered to have "identical compositions" within the meaning of this patent application, since the compositions of both alloys fall within the stated limits of AA2199, even though the compositions are not perfectly identical.

As noted above, the first aluminum alloy and the similar aluminum alloy may be prepared identically for artificial aging. For purposes of this patent application, "prepared identically for artificial aging" and the like means that the similar aluminum alloy is prepared utilizing the same procedures used to prepare the first aluminum alloy for artificial aging, including times and temperatures for thermal processes, and within normal tolerances for the processing conditions, such that both end products are of substantially similar form and have substantially similar dimensions.

As used herein, "solution heat treating" and the like means heating an alloy to a suitable temperature (e.g., above 800° F.), and holding the alloy at that temperature long enough to cause constituents to dissolve and enter into solid solution.

As used herein, "quenching" and the like means rapid cooling of an alloy, such as by spraying or immersion. In some metallic materials, quenching may be used to restrict, for example, phase transformations from occurring by narrowing the period of time in which such transformations could occur.

As used herein, "cold deformation" and the like means to work an alloy with the primary purpose to strengthen a material by increasing the material's dislocation density. Physical deformation of the material generally increases the concentration of dislocations, which may subsequently form dislocation tangles and/or low-angle grain boundaries surrounding sub-grains. These internal changes impede the motion of dislocations hindering further plasticity. In some alloy systems, such as 2xxx and 8xxx series alloys, the introduction of dislocations by cold deformation may also accelerate precipitation during artificial aging and/or increase precipitate density. Cold deformation, sometimes referred to as cold working, generally results in a higher strength and a decrease in ductility.

As used herein, "aging" and the like means a treatment technique used to strengthen metallic materials, including most structural alloys of aluminum. Natural aging occurs at ambient temperatures over a period of time, while artificial aging occurs when the alloy is heated to at least one temperature above room temperature for at least one selected period of time.

As used herein, "artificial aging" and the like means heating an aluminum alloy to at least one temperature above room temperature for at least one selected period of time. Artificial aging can be accomplished via any known methodology and in any number of steps, such as, for example, while heating, cooling, ramping heating and cooling and in several steps and integrating the temperature and time exposures above room temperature, to name a few.

In one embodiment, the fatigue crack growth resistance is constant amplitude fatigue crack growth resistance (CAFCGR). CAFCGR is the resistance to the growth of a crack under fatigue loading (e.g., cyclic loading) of a constant or slowly increasing or decreasing load or stress amplitude. A higher fatigue crack growth resistance is measured by a lower crack growth rate per load cycle (da/dN) as a function of ΔK, or in terms of a greater number of load cycles to specimen failure, or between an initial and final crack length. CAFCGR may be measured in accordance with ASTM E647-05. "ΔK" is the linear elastic stress intensity factor range ($K_{max}$-$K_{min}$), which the fatigue crack is subjected to during a fatigue crack growth test in a given load cycle. "ΔK" is calculated using the applied maximum load ($P_{max}$) and minimum load ($P_{min}$) In a constant amplitude fatigue crack growth test, ΔK changes slowly as the fatigue crack extends or grows under cyclic loading. The units for ΔK are typically MPa√m or ksi√in. The "stress ratio" is the ratio of the minimum load to the maximum load ($P_{min}/P_{max}$) or its equivalent expressed in term of K (i.e., $K_{min}/K_{max}$) The stress ratio is typically held constant for the entire test for a constant amplitude fatigue crack growth test.

In some of these embodiments relating to CAFCGR, the first aluminum alloy product may be a first plate product or a first sheet product. In related embodiments, the similar aluminum alloy is a similar plate product or a similar sheet product, respectively. In other ones of these embodiments, the first aluminum alloy is an extrusion or forging, and the similar aluminum alloy is a similar extrusion product or a similar forging product, respectively.

When the first aluminum alloy is a first plate product, the first plate product may realize (i) the above-noted strength improvements, and at least equal CAFCGR as compared to the similar plate product, or (ii) improved CAFCGR and at least equal strength as compared to the similar plate product. In this regard, the CAFCGR performance is generally measured at a ΔK in the range of from about 11 MPa√m to about 30 MPa√m. In one embodiment, the at least equal CAFCGR occurs at a ΔK of at least about 11 MPa√m and not greater than about 25 MPa√m. In one embodiment, the at least equal CAFCGR occurs at a ΔK of not greater than about 20 MPa√m. In one embodiment, the at least equal CAFCGR occurs at a ΔK of not greater than about 15 MPa√m. In one embodiment, the crack growth rate (da/dN) of the first plate product is at least about 5% lower than the similar plate product at equivalent ΔK. In one embodiment, da/dN of the first plate product is at least about 15% lower than the similar plate product at equivalent ΔK. In one embodiment, da/dN of the first plate product is at least about 25% lower than the similar plate product at equivalent ΔK. In one embodiment, da/dN of the first plate product is at least about 50% lower than the similar plate product at equivalent ΔK.

As used herein, a "first plate product" is a wrought aluminum alloy plate product prepared and artificially aged, as claimed, wherein the plate has a thickness of at least 0.250 inch after hot rolling. In some embodiments, the wrought material is hot rolled to gage and then solution heat treated to produce the plate product.

As used herein, a "similar plate product" is a similar aluminum alloy plate product having an identical composition to a first plate product, and is prepared identically for artificial aging as the first plate product. The similar plate product is artificially aged identically to the first plate product, except that the similar plate product is finally aged either (i) at a temperature of greater than 225° F. or (ii) at a temperature of not greater than 225° F. but for less than 20 hours.

As used herein, "at least equal CAFCGR as compared to a similar plate product" means that the first plate product has at least equal CAFCGR as compared to the similar aluminum alloy plate product when the CAFCGR is measured in accordance with ASTM E647-05 in the L-T direction at a stress ratio (R) of 0.1, a test frequency of 25 Hz, and in a moist air environment of relative humidity of at least 90%, using an M(T) specimen having a width (W) of 4.0 inches and a thickness (B) of 0.25 inch, and at a ΔK in the range of 11-30 MPa√m. The testing is performed using a constant minimum and maximum load.

When the first aluminum alloy is a first sheet product, the first sheet product may realize (i) the above-noted strength improvements, and at least equal CAFCGR as compared to a similar sheet product, or (ii) improved CAFCGR resistance and at least equal strength as compared to the similar sheet product. In one embodiment, the CAFCGR is at least equal L-T CAFCGR or T-L CAFCGR as compared to the similar sheet product, and generally when the CAFCGR is measured at a ΔK in the range of from about 10 MPa√m to about 45 MPa√m. In one embodiment, the ΔK is at least 25 MPa√m, and/or in the range of from about 25 to about 45 MPa√m.

As used herein, a "first sheet product" is a wrought aluminum alloy sheet product prepared and artificially aged, as claimed, wherein (i) the sheet has a thickness of not greater than 0.249 inch, or (ii) or as rolled stock in thicknesses less than or equal to 0.512 inch (13 mm) thick when cold rolled after the final hot working and prior to solution heat treatment.

As used herein, a "similar sheet product" is a similar aluminum alloy sheet product having an identical composition to a first sheet product, and is prepared identically for artificial aging as the first sheet product. The similar sheet product is artificially aged identically to the first sheet product, except that the similar sheet product is finally aged either (i) at a temperature of greater than 225° F. or (ii) at a temperature of not greater than 225° F. but for less than 20 hours.

As used herein, "at least equal L-T CAFCGR as compared to a similar sheet product" and the like means that the first plate sheet has at least equal CAFCGR as compared to the similar aluminum alloy sheet product when the CAFCGR is measured in accordance with ASTM E647-05 in the L-T direction at a stress ratio (R) of 0.1, a test frequency in the range of 4-8 Hz and in a moist air environment of relative humidity of at least 20%, using an M(T) specimen having a width (W) of 400 millimeters, and a ΔK in the range of from about 10 MPa√m to about 45 MPa√m. In one embodiment, the ΔK is the range of from about 25 MPa√m to about 45 MPa√m.

As used herein, "at least equal T-L CAFCGR as compared to a similar sheet product" and the like means that the first plate sheet has at least equal CAFCGR as compared to the similar aluminum alloy sheet product when the CAFCGR is measured in accordance with ASTM E647-05 in the T-L direction at a stress ratio (R) of 0.1, a test frequency in the range of 4-8 Hz and in a moist air environment of relative humidity of at least 20%, using an M(T) specimen having a width (W) of 400 millimeters, and at a ΔK in the range of from about 10 MPa√m to about 45 MPa√m. In one embodiment, the ΔK is in the range of from about 25 MPa√m to about 45 MPa√m.

In one embodiment, the fatigue crack growth resistance is spectrum fatigue crack growth resistance (SFCGR). SFCGR is the resistance to the growth of a crack under fatigue loading of variable amplitude (i.e., spectrum loading). Unlike constant amplitude fatigue crack growth, the load amplitude, stress ratio and ΔK may change significantly from one load cycle to the next. For most aircraft structure, spectrum loading is more representative of the loading experienced by the aircraft in service than constant amplitude loading. For example, a lower wing load spectrum typically includes not only the basic flight loads but also flight maneuver and gust loads, landing loads and ground maneuver or taxi loads. Spectrum fatigue crack growth resistance is better when there is (i) a lower rate of crack growth per load cycle or simulated flight under spectrum loading, or (ii) a greater number of spectrum load cycles or simulated flights to specimen failure or between an initial and final crack length. Currently, there is no ASTM or industry standard for conducting spectrum fatigue crack growth testing, but such testing is well known to those skilled in the art. Historically, each aircraft manufacturer has typically developed their own proprietary test method(s), test specimen(s) and aircraft specific spectrum. However, several generic aircraft spectrum have been developed, including the lower wing spectra TWIST and MiniTWIST, which are well known in the industry and commonly used to assess and compare spectrum fatigue crack growth resistance of aluminum alloys. TWIST stands for Transport Wing Standard. MiniTWIST is a shortened version of TWIST where many cycles corresponding to the lowest gust load have been omitted (MiniTWIST contains 58442 cycles of the lowest gust level instead of 398665 in TWIST per 1 block of 4000 flights). This significantly shortens the length of time to run a single test. See, e.g. J. B. De Jonge, D. Schutz, H. Lowak and J. Schijve "Standardized load sequence for flight simulation tests on transport aircraft wing structures' TR-73029, National Aerospace Laboratory, NLR, Amsterdam, 1973; and H. Lowak, J. B. De Jonge, J. Franz and D. Schutz, "MiniTWIST, a shortened version of TWIST", MO 79018, National Aerospace Laboratory, NLR, Amsterdam, 1979; both of which are herein incorporated by reference in their entirety.

In some of these embodiments relating to SFCGR, the first aluminum alloy may be a first plate product. In related embodiments, the similar aluminum alloy is a similar plate product. In other ones of these embodiments, the first aluminum alloy is a sheet, extrusion or forging, and the similar aluminum alloy is a similar sheet, extrusion or forging product, respectively.

When the first aluminum alloy is a first plate product, the first plate product may realize (i) the above-noted strength improvements, and at least equal SFCGR as compared to the similar plate product, or (ii) improved SFCGR resistance and at least equal strength as compared to the similar plate product. In one embodiment, the first plate product realizes at least a 1% increase in spectrum flights between a half crack length of 25 mm (0.98 inch) and 65 mm (2.56 inches) as compared to the similar plate product. In one embodiment, the first plate product realizes at least a 5% increase in spectrum flights over this half crack length as compared to the similar plate product. In one embodiment, the first plate product realizes at least a 10% increase in spectrum flights over this half crack length as compared to the similar plate product. In one embodiment, the first plate product realizes at least a 25% increase in spectrum flights over this half crack length as compared to the similar plate product. In one embodiment, the first plate product realizes at least a 50% increase in spectrum flights over this half crack length as compared to the similar plate product.

As used herein, "at least equal SFCGR as compared to a similar plate product" and the like means that the first plate product has at least equal SFCGR as compared to the similar aluminum alloy plate product when the SFCGR is measured using the MiniTWIST spectrum, truncated at Level III, with a mean flight stress of 9.8 ksi, at a test frequency of not greater than 10 Hz, in a moist air environment having a relative humidity of at least 90%, and using an M(T) specimen having a thickness of 12 mm (7.87 inches) and a width of 200 mm (0.47 inches). "Mean flight stress" and the like means the stress at 1 G corresponding to level and straight flight at cruise speed, altitude and weight. The stress deviates from the mean flight stress due to maneuver, gust, landing and taxi loads. "Truncation level" and the like means the gust level in the spectrum above which the gust loads are not allowed to exceed. The highest gust loads which are expected to occur infrequently over the life of the aircraft may cause significant crack retardation (i.e., crack slowing) effects in aluminum alloys. As gust loads this severe may not actually occur in the life of every aircraft in service and because their inclusion may give optimistic (i.e., slow) crack propagation rates, the highest gust loads are frequently truncated to a lower gust level. For example, the lower wing spectrum MiniTWIST is typically truncated at Level III, which truncates the three highest gust loads in a block of 4000 flights.

As described above, the aluminum alloys may be prepared with a multi-step artificial aging process. In one embodiment, the artificial aging step is at least a three-step process and includes the above described (i) aging and (ii) final aging steps. In this embodiment, the aging also includes second aging the wrought aluminum alloy at a temperature in the range of from about 250° F. to about 330° F., where the second aging occurs after the aging step (ii)(c) and before the final aging step (ii)(d). Nonetheless, all the aging steps may be completed concomitant to one another.

With respect to the final aging step, "final aging" and the like means the final artificial aging step conducted on an aluminum alloy product before it is cooled to room temperature in preparation for its end use. Conversely, "initial aging" and the like means a first artificial aging step subsequent to solution heat treatment and optional cold deformation to be followed by one or more additional aging steps. In one embodiment, the final aging step is isothermic or stepped aging. In other words, in this embodiment, the final aging step occurs at a given temperature for a specified period of time.

In one embodiment, the final aging step is defined by an Arrhenius equation. As used herein, "Arrhenius Equation" or "Arrhenius Relationship" is a mathematical description of a given property which changes as a function of temperature due to the property being based on a thermally activated process. An Arrhenius equation can be derived for any given alloy if a few time and temperature points are known. For example, FIG. 2 demonstrates several Arrhenius relationships defined by the equations ln (natural log)(time)=x(1/T)−y; where:

a. (time) is cumulative time of final aging;

b. In is a natural logarithm;

c. T is the temperature at a given cumulative time of final aging;

d. x is a constant; and e. y is a constant.

In one embodiment, the final aging occurs at a series of temperatures which change over time where the total aging effect can be given by an Arrhenius equation. This is known as ramped aging and means that any change in temperature occurs in a continuously changing fashion over time.

Aluminum alloys realizing the above-described strength and fatigue crack growth improvements are generally 2xxx or 8xxx series alloys containing lithium. In one embodiment, an aluminum alloy comprises at least 0.1 wt. % Li (e.g., 0.5-2.7 wt. % Li). In some embodiments, the aluminum alloys also include silver. In one embodiment, the aluminum alloy comprises silver in the range of 0.1-0.7 wt. %.

Figure 1A:
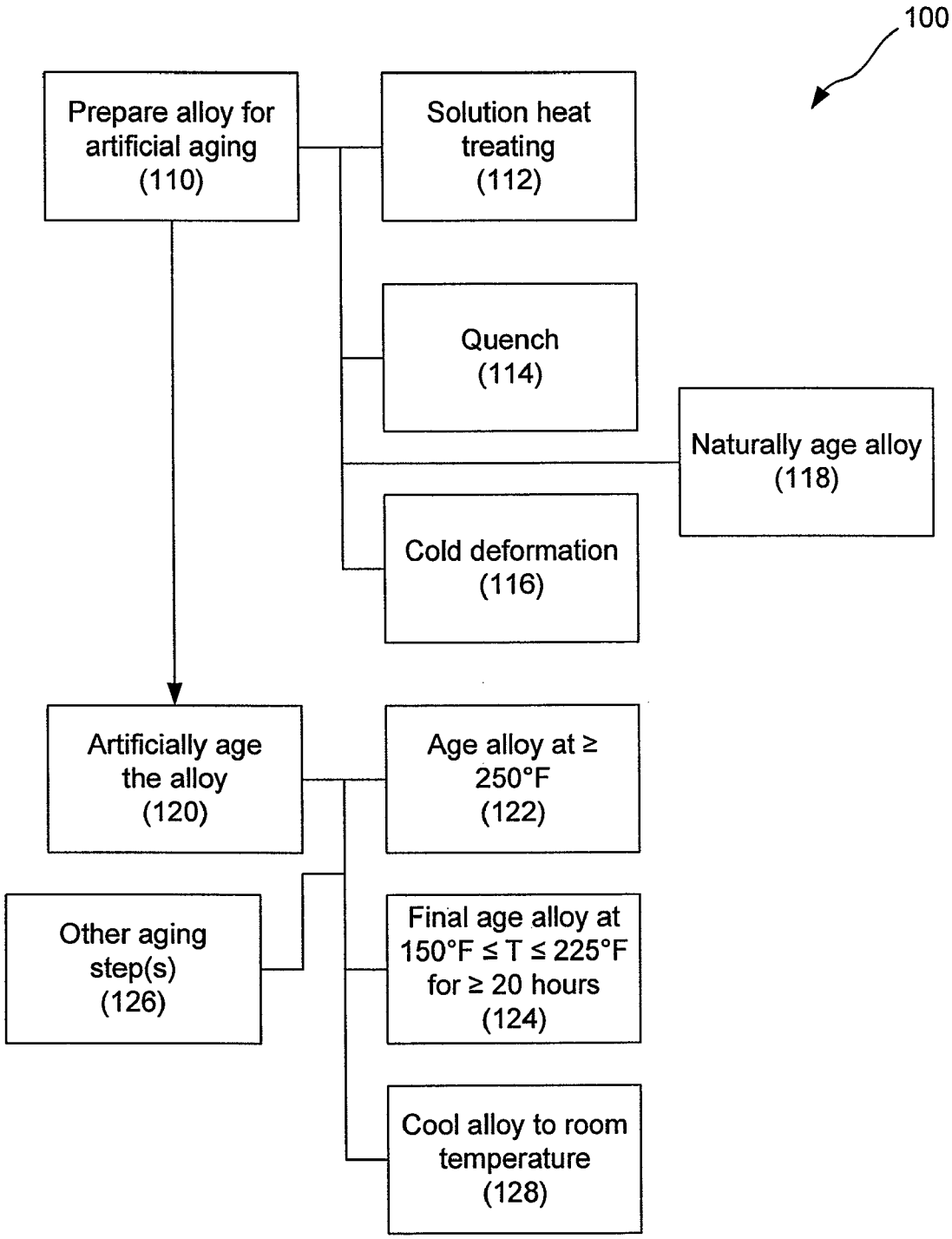
FIG. 1A is a chart illustrating one embodiment of a method for producing the new alloys described herein.

While the above-identified drawings set forth presently disclosed embodiments, other embodiments are also contemplated, as noted in the below detailed description. This disclosure presents illustrative embodiments by way of representation and not limitation. Numerous other modifications and embodiments can be devised by those skilled in the art which fall within the scope and spirit of the principles of the present disclosure.

DETAILED DESCRIPTION

Reference is now made to the accompanying drawings, which at least assist in illustrating various pertinent features of the new alloys disclosed herein. These embodiments are merely illustrative of the new alloy. In addition, each of the examples given in connection with the various embodiments of the new alloy is intended to be illustrative, and not restrictive. Further, the figures are not necessarily to scale and some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the new alloy disclosed herein.

The instant disclosure relates to new aluminum alloys having improved properties. In one embodiment, the improved properties include an improvement in strength with at least equal fatigue crack growth performance. In some embodiments, the improved properties include an improvement in both strength and fatigue crack growth performance. In other embodiments, the improved properties include an improvement in fatigue crack growth performance with at least equal strength.

The new alloys of the instant disclosure are generally aluminum-lithium based alloys. In some embodiments, the new alloys also include silver. The new alloys may be any 2xxx or 8xxx series alloys containing lithium. In some embodiments, the aluminum alloy comprises copper and lithium as primary alloying additions, but may also optionally include magnesium, silver and zinc as alloying additions.

A broadly stated 2xxx or 8xxx alloy of the present disclosure may include 2.2-4.4 wt. % Cu, and/or at least 0.1 wt. %

Li (e.g., 0.5-2.7 wt. % Li), up to 1.2 wt. % Mg, up to 0.8 wt. % Ag, up to 1.0 wt. % Zn, at least one element or compound for grain structure control, the balance being aluminum, and incidental elements and impurities. In some embodiments, the 2xxx or 8xxx aluminum alloy comprises (and in some instances consists essentially of) one of the following alloys and its alloying constituents (all values in wt. %):

TABLE 1

Examples of Al—Cu—Li containing alloys

| | Cu | Mg | Li | Ag | Zn |
|---|---|---|---|---|---|
| Alloy 1 | 2.3-2.9 | 0.05-0.40 | 1.4-1.8 | — | 0.2-0.9 |
| Alloy 2 | 2.4-3.0 | 0.1-0.50 | 1.6-2.0 | — | 0.4-1.0 |
| Alloy 3 | 2.4-3.0 | 0-0.25 | 1.9-2.6 | — | 0-0.1 |
| Alloy 4 | 2.5-3.1 | 0-0.25 | 1.1-1.7 | — | 0-0.15 |
| Alloy 5 | 3.0-3.8 | 0.05-0.50 | 0.9-1.4 | — | 0.1-0.5 |

TABLE 2

Examples of Al—Cu—Li—Ag containing alloys

| | Cu | Mg | Li | Ag | Zn |
|---|---|---|---|---|---|
| Alloy 6 | 2.9-3.5 | 0.25-0.8 | 0.8-1.1 | 0.1-0.5 | 0-0.35 |
| Alloy 7 | 3.2-3.8 | 0.25-0.8 | 0.8-1.3 | 0.25-0.6 | 0-0.35 |
| Alloy 8 | 3.7-4.3 | 0.25-0.8 | 0.8-1.2 | 0.25-0.6 | 0-0.25 |
| Alloy 9 | 2.5-3.3 | 0.25-0.8 | 1.4-2.1 | 0.25-0.6 | 0-0.25 |
| Alloy 10 | 3.4-4.2 | 0.6-1.1 | 0.6-0.9 | 0.1-0.5 | 0.3-0.45 |
| Alloy 11 | 3.2-4.2 | 0.1-0.6 | 0.9-1.4 | 0.2-0.7 | 0.2-0.7 |

Grain structure control elements or compounds are deliberate alloying additions with the goal of forming second phase particles, usually in the solid state, to control solid state grain structure changes during thermal processes, such as recovery and recrystallization. Examples of grain structure control elements include Zr, Sc, Hf, Cr, Mn, to name a few.

The amount of grain structure control material utilized in an alloy is generally dependent on the type of material utilized for grain structure control and the alloy production process. When zirconium (Zr) is included in the alloy, it may be included in an amount up to about 0.4 wt. %, or up to about 0.3 wt. %, or up to about 0.2 wt. %. In some embodiments, Zr is included in the alloy in an amount of 0.04-0.18 wt. %. Scandium (Sc) and hafnium (Hf) may be included in the alloy as a substitute (in whole or in part) for Zr, and thus may be included in the alloy in the same or similar amounts as Zr. Manganese (Mn) may be included in the alloy in addition to or as a substitute (in whole or in part) for Zr. When Mn is included in the alloy, it may be included in an amount of up to about 1.0 wt. %, or up to about 0.6 wt. %, or up to about 0.4 wt. %, or up to about 0.2 wt. %. In some embodiments, Mn is included in the alloy in an amount of 0.05 wt. % to about 0.4 wt. % or 1.0 wt. %. Like Mn, chromium (Cr) may be included in the alloy in addition to or as a substitute (in whole or in part) for Zr. When Cr is included in the alloy, it may be included in an amount of up to about 0.3 wt. %, or up to about 0.2 wt. %, or up to about 0.1 wt. %. In some embodiments, Cr is included in the alloy in an amount of 0.01 wt. % to about 0.1 wt. % or 0.2 wt. %.

Incidental elements are those elements or materials that may optionally be added to the alloy to assist in the production of the alloy. Examples of incidental elements include casting aids, such as grain refiners and deoxidizers.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners may be utilized. When Ti is included in the alloy, it is generally present in an amount of up to about 0.10 or 0.20 wt. % Ti. In some embodiments, Ti is included in the alloy in an amount of 0.01 wt. % to about 0.10 wt. % or 0.20 wt. %.

Deoxidizers are materials added to the alloy during casting to reduce or restrict cracking of the ingot (irrespective of whether actual "deoxidation" occurs). Examples of deoxidizers includes Ca, Sr, and Be. The amount of deoxidizer included in the alloy is generally dependent on the type of material utilized for deoxidizing and the alloy production process. When calcium (Ca) is included in the alloy, it is generally present in an amount of up to about 0.05 wt. %, or up to about 0.03 wt. %. In some embodiments, Ca is included in the alloy in an amount of 0.001-0.03 wt % or 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have served as a deoxidizer/ingot cracking deterrent. Though for environmental, health and safety reasons, some embodiments of the alloy are substantially Be-free. When Be is included in the alloy, it is generally present in an amount of up to about 0.03 wt. %.

Incidental elements may be present in minor amounts, or may be present in significant amounts, and may add desirable or other characteristics on their own without departing from the alloys described herein, so long as the alloy achieves the improved combination of properties described herein. It is to be understood, however, that the scope of this disclosure should not and cannot be avoided through the mere addition of an element or elements in quantities that would not otherwise impact on the combinations of properties desired and attained herein.

Impurities are those materials that may be present in the alloy in minor amounts due to, for example, the aluminum production process and/or leaching from contact with manufacturing equipment. Iron (Fe) and silicon (Si) are examples of impurities generally present in aluminum alloys. The Fe content of the alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.04 or 0.05 wt. %. Likewise, the Si content of the alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.02 or 0.03 wt. %.

In some embodiments, magnesium (Mg) is included in the alloy as an impurity, but in other embodiments purposeful additions of Mg are present in the alloy. When purposeful additions of Mg are included in the alloy, the alloy generally includes at least about 0.1 wt. % Mg, and the upper limit of Mg may be any of 0.25 wt. %, or 0.40 wt. %, or 0.50 wt. %, or 0.8 wt. %, or 1.0 wt. %.

In some embodiments, zinc (Zn) is included in the alloy as an impurity, but in other embodiments purposeful additions of Zn are present in the alloy. When purposeful additions of Zn are included in the alloy, the alloy generally includes at least about 0.25 wt. % Zn, and the upper limit of Zn may be any of 0.4 wt. %, 0.6 wt. %, 0.8 wt. %, and 1.0 wt. %.

In some embodiments, silver (Ag) is included in the alloy as an impurity, but in other embodiments purposeful additions of Ag are present in the alloy. When purposeful additions of Ag are included in the alloy, the alloy generally includes at least about 0.05 wt. % Ag, and the upper limit of Ag may be any of 0.3 wt. %, or 0.4 wt. %, or 0.5 wt. %, or 0.6 wt. %, or 0.7 wt. %, or 0.8 wt. %.

In some embodiments, the new alloy is a lithium containing alloy, such as, for example, AA2199, AA2099, AA2090, AA2397, or AA2297. In other embodiments, the new alloy is a lithium and silver containing alloy, such as, for example, AA2198, AA2098, AA2195, and/or AA2196. In another embodiment, the new alloy is an 8xxx series alloy comprising lithium, such as, for example AA8090, AA8091 or AA8093.

Except where stated otherwise, the expression "up to" when referring to the amount of an element means that that elemental composition is optional and includes a zero amount of that particular compositional component. Unless stated otherwise, all compositional percentages are in weight percent (wt. %).

The new alloys of the instant disclosure generally achieve an improved combination of properties. These properties may be attained, for instance, via the unique processing conditions utilized to produce the new alloys. One embodiment of a method for producing the new alloys is illustrated in FIG. 1A. In the illustrated embodiment, the method (100) includes the steps of preparing a wrought aluminum alloy for artificial aging (110), and artificially aging the wrought aluminum alloy (120). The preparing (110) and artificial aging (120) steps may be conducted in any manner to produce the desired temper (e.g., any of, but not limited to, T6, T62, T81, T83, T84, T851, T8510, T8511, T86, T87 and T89).

The preparing step (110) may include solution heat treating the alloy (112), quenching the alloy (114), and optional cold deforming the alloy (116), to name a few. The preparing step (110) may substantially include one or more natural aging steps (118), which may occur before or after the optional cold deformation step (116).

The artificial aging step (120) is a multi-step artificial aging process, and at least includes a step of aging the aluminum alloy at a temperature of at least 250° F. (122), and final aging the wrought aluminum alloy at a temperature of less than 250°, such as in the range of 150° F. to 225° F., for at least 20 hours (124). In some embodiments, the minimum final aging temperature is at least about 175° F.

The wrought aluminum alloy may be any wrought product, such as any of a rolled product (sheet or plate), extrusion, or forging, for instance. In one embodiment, the wrought aluminum alloy is a sheet product. In one embodiment, the wrought aluminum alloy is a plate product. In one embodiment, the wrought aluminum product is a forging. In one embodiment, the wrought aluminum product is an extrusion.

The solution heat treatment step (112) may occur at a temperature ($T_{SHT}$) that is sufficiently high to facilitate solution heat treatment, and for a duration that is sufficiently long to produce a solution heat treated alloy. For some aluminum alloys the solution heat treat temperature may be at least 800° F., and the duration may be at least 1 hour.

The quenching step (114) is generally completed after, or concomitant to, the solution heat treatment step (112) and may be accomplished via any suitable apparatus or process, such as immersion or spray quenching. In some embodiments, the quenching medium may be, for example, an aqueous solution, such as water. In other embodiments, the quenching medium is a solid medium, such as, for example, sand. In some embodiments, a solution heat treated and quenched alloy is capable of precipitation hardening. In some embodiments, the quenched alloy is precipitation hardened during the aging process, such as, for example, via the methods disclosed in U.S. Pat. No. 3,645,804.

The optional cold deforming step (116) is generally completed after, or concomitant to, the quenching step (114). The cold deforming may be accomplished, for example, via stretching, compression or a combination thereof. The cold deforming step is generally completed before, or concomitant to, the artificial aging step (120).

The artificial aging step (120) is generally a multi-step aging process comprising at least (i) a step of aging at a first temperature $T_1$, which is a temperature greater than 250° F. (122), and (ii) a final aging step (124), which occurs at a temperature T for a duration of at least 10 or 20 hours, where T is a temperature in the range of 150° F. to 225° F. As illustrated below, the duration and temperature of this final aging step (124) at least partially assists in facilitating production of alloys having the improved properties described herein. After the final aging step (124), the alloy may be cooled to room temperature (128). The artificial aging step (120) may also optionally include any number of other aging steps (126) conducted before or after the aging (122) step, and before the final aging step (124). The aging steps are generally completed in series and concomitant to one another.

With respect to the step of aging at a first temperature $T_1$, which is a temperature greater than 250° F. (122), the temperature and duration of this step are alloy dependent, but are generally in the range of 270 to 310° F. and 20 to 48 hours.

With respect to the final aging step (124), the final aging temperature $T_F$ is generally alloy dependent, but is generally in the range of 150° F. to 225° F., or 176° F. to 200° F. Correspondingly, the aging duration is alloy and temperature dependent. In one embodiment, the duration of the final aging step (124) is not greater than 5,000 hours. In other embodiments, the duration of the final aging step (124) is not greater than 2,000 hours, or not greater than 1,000 hours, or not greater than 500 hours, or even not greater than 150 hours or 100 hours.

Figure 1B:
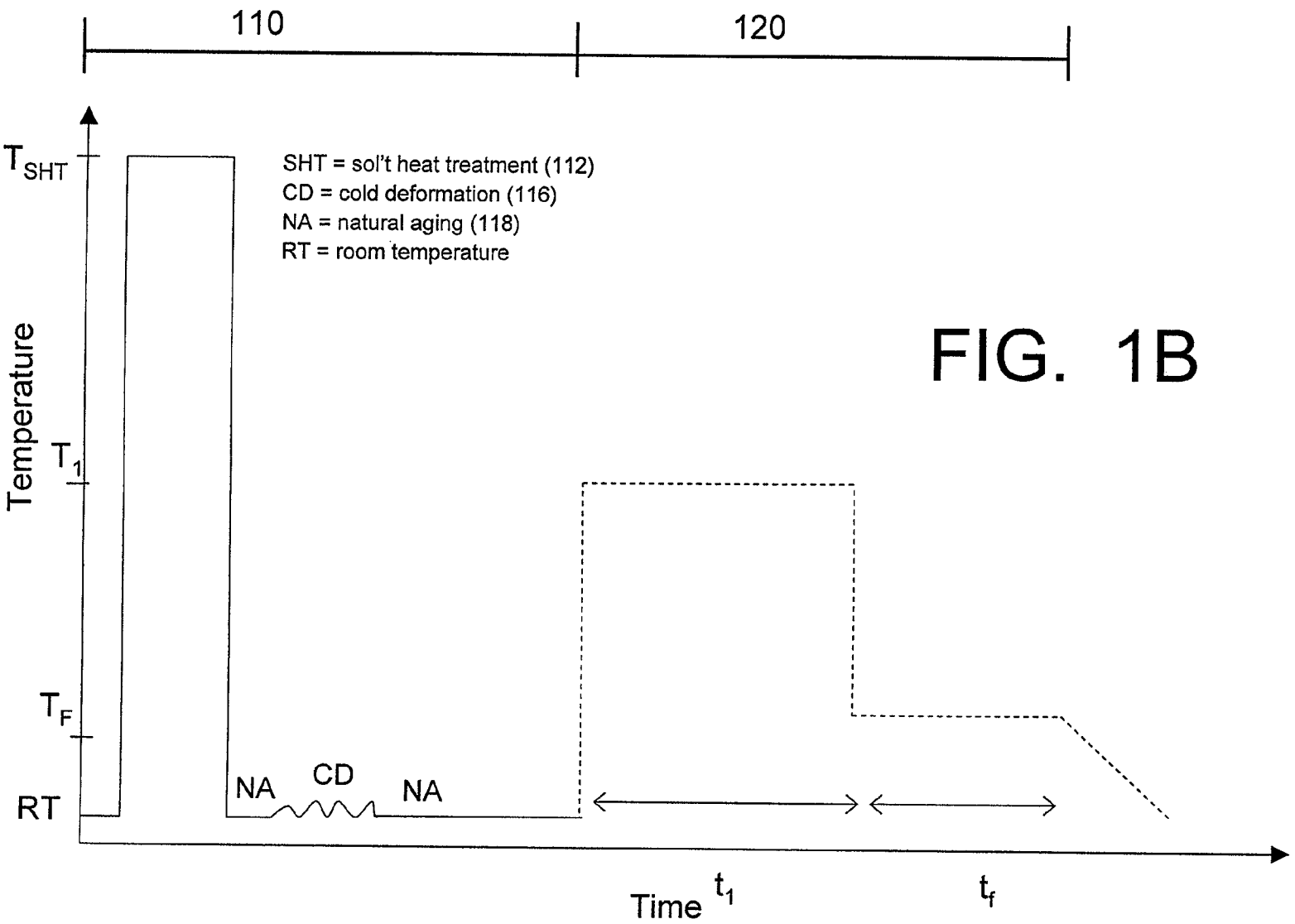
FIG. 1B is a chart illustrating one embodiment of a method for producing a new alloy.

Various embodiments of methods useful in producing alloys having improved properties are illustrated in FIGS. 1B-1F. Referring now to FIG. 1B, a two-step, stepped aging process is illustrated. After the preparing step (110), the initial aging step is completed by stepping up the temperature of the alloy from room temperature (RT) to $T_1$, which is a temperature of at least 250° F. The alloy is then held at $T_1$ for time $t_1$. The duration of time $t_1$ is alloy dependent, but generally is in the range of 20 to 48 hours in this embodiment. Next, the aging temperature is stepped down to the final aging temperature $T_F$, which is a temperature in the range of 150 to 225° F. The alloy is then held at $T_F$ for time $t_f$. The duration of time $t_f$ is alloy dependent, but generally is in the range of 20-5000 hours in this embodiment. The alloy is then allowed to cool to room temperature.

Figure 1C:
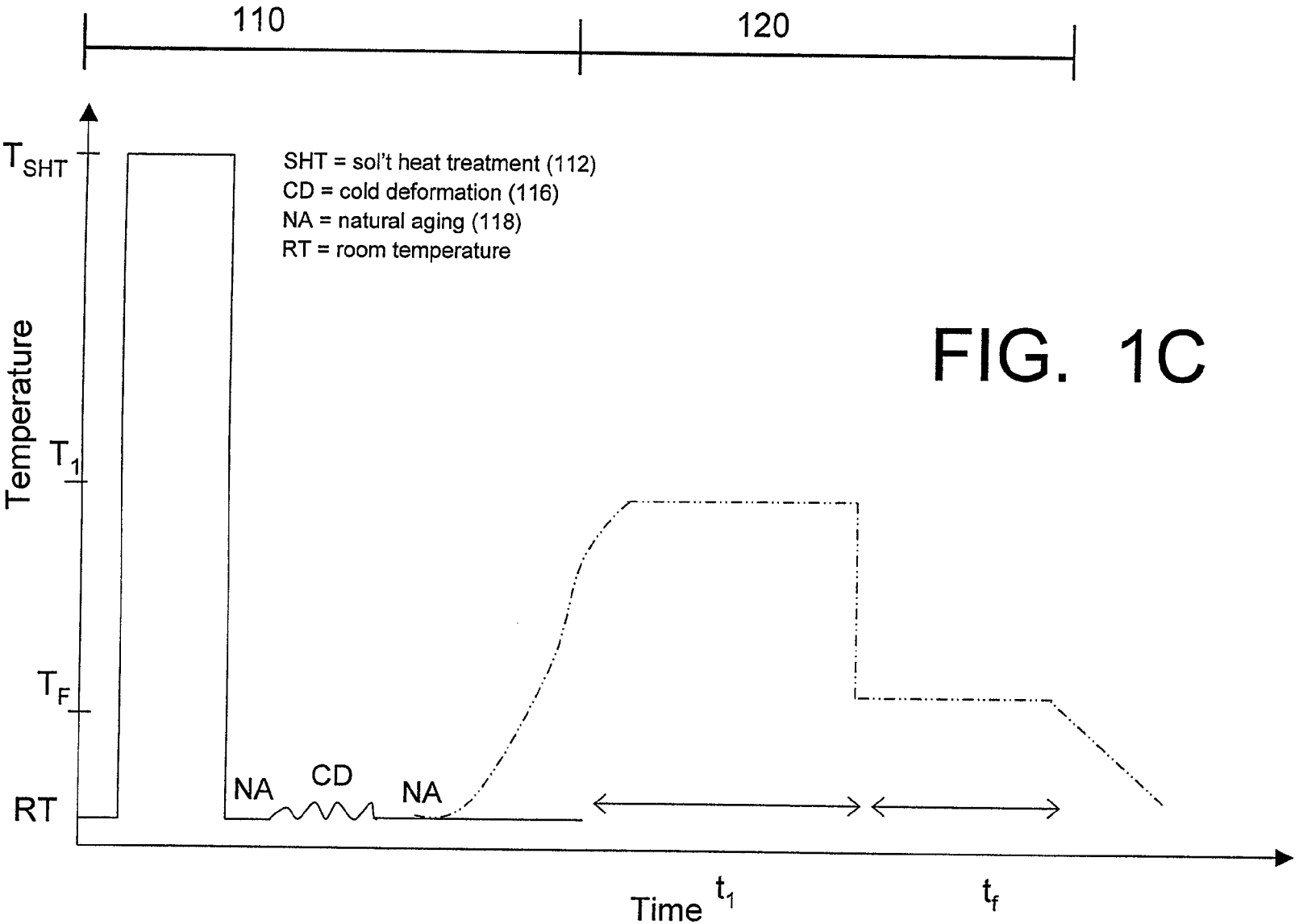
FIG. 1C is a chart illustrating one embodiment of a method for producing a new alloy.

Referring now to FIG. 1C, a two-step, ramped-to-stepped aging process is illustrated. After the preparing step (110), the initial aging step is completed by ramping up the temperature of the alloy from room temperature to $T_1$, which is a temperature of at least 250° F. The alloy is then held at $T_1$ for time $t_1$. The duration of time $t_1$ is alloy dependent, but generally is in the range of 20 to 48 hours in this embodiment. Next, the aging temperature is stepped down to the final aging temperature $T_F$, which is a temperature in the range of 150 to 225° F. The alloy is then held at $T_F$ for time $t_f$. The duration of time $t_f$ is alloy dependent, but generally is in the range of 20-5000 hours in this embodiment. The alloy is then allowed to cool to room temperature.

Figure 1D:
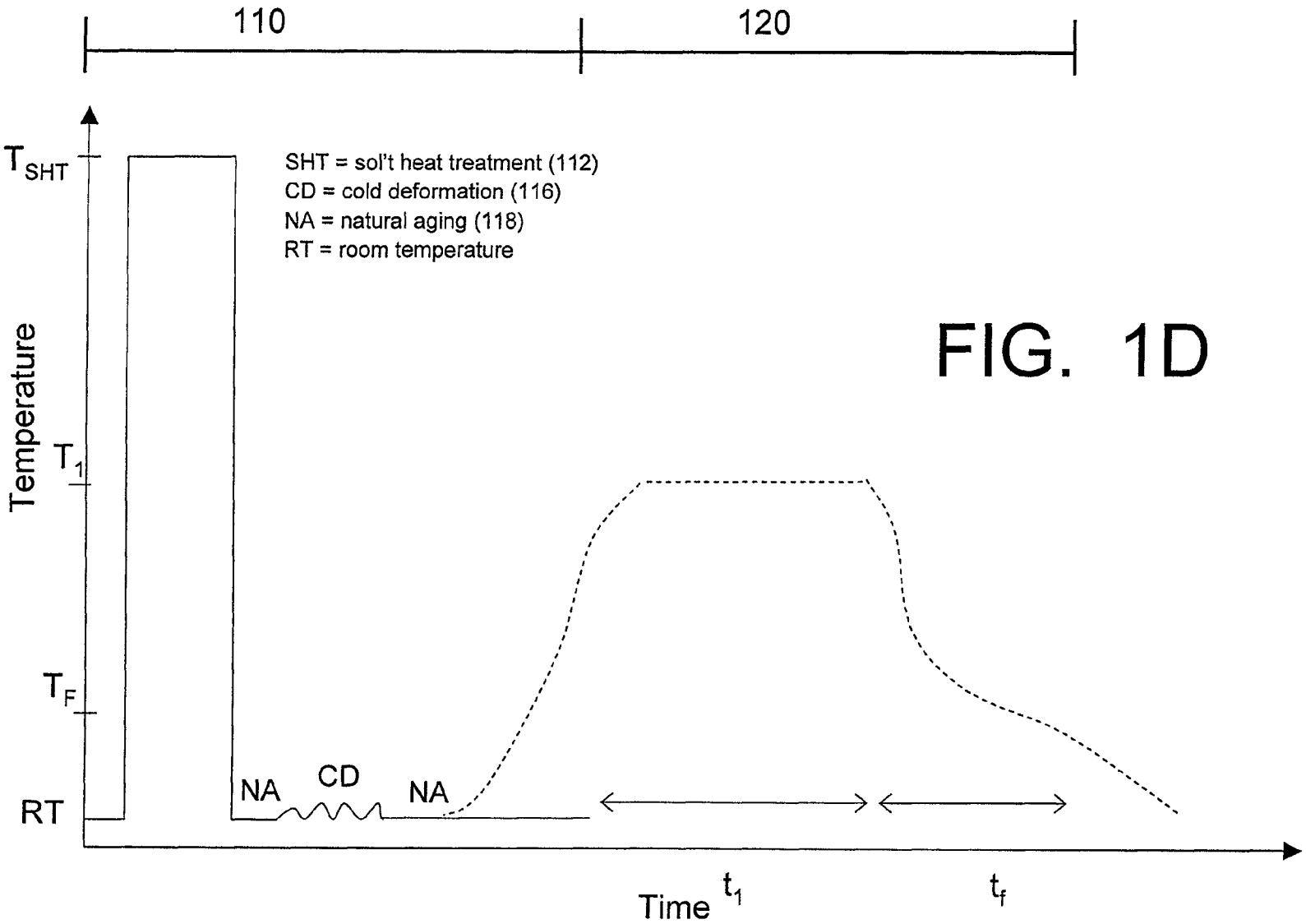
FIG. 1D is a chart illustrating one embodiment of a method for producing a new alloy.

Referring now to FIG. 1D, a two-step, ramped-to-ramped aging process is illustrated. After the preparing step (110), the initial aging step is completed by ramping up the temperature of the alloy from room temperature to $T_1$, which is a temperature of at least 250° F. The alloy is then held at $T_1$ for time $t_1$. The duration of time $t_1$ is alloy dependent, but generally is in the range of 20 to 48 hours in this embodiment. Next, the aging temperature is ramped down slowly through the range of the final aging temperature $T_F$, which is the range of 150 to 225° F. The alloy is then allowed to cool to room temperature.

Figure 1E:
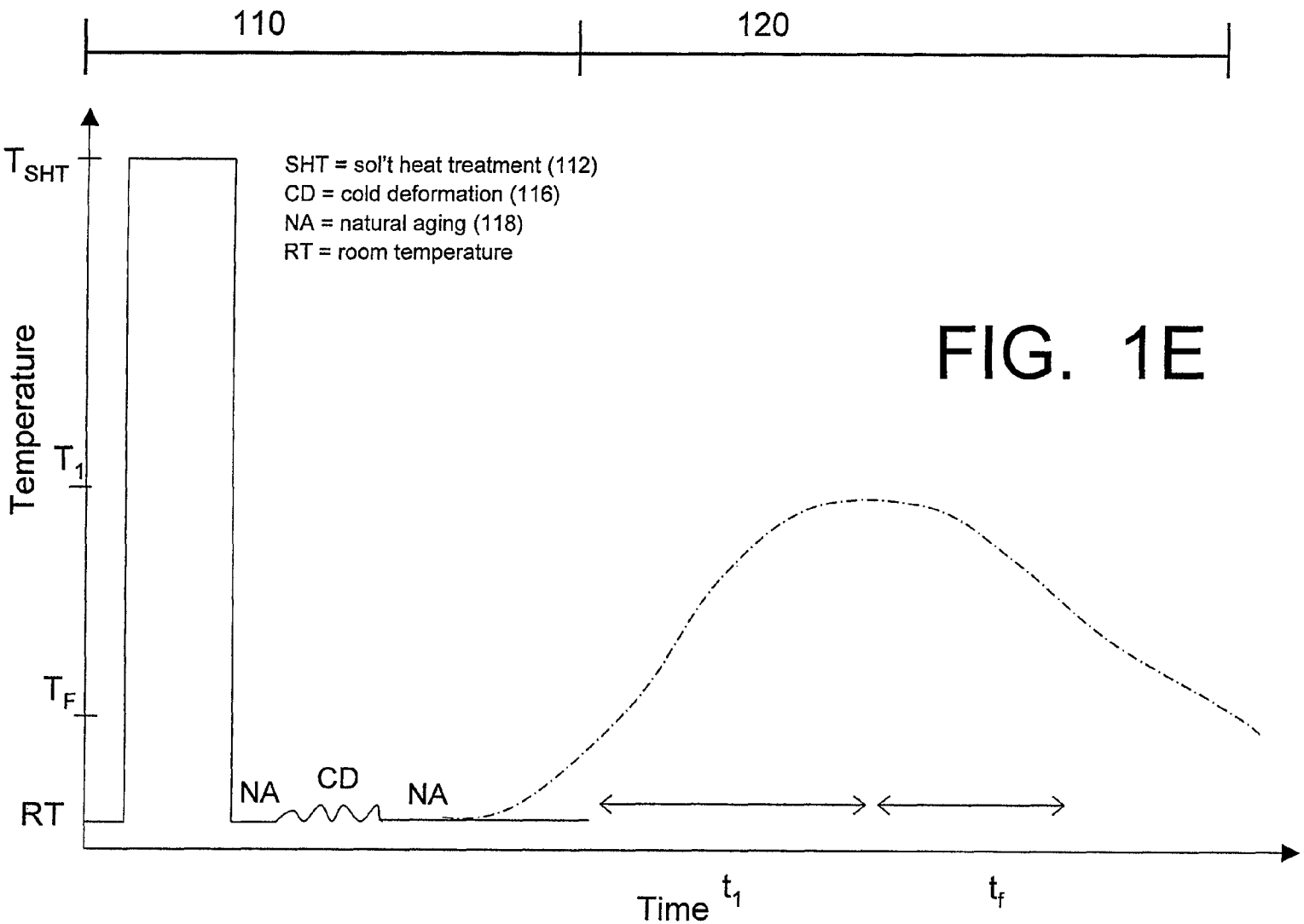
FIG. 1E is a chart illustrating one embodiment of a method for producing a new alloy.

Referring now to FIG. 1E, a continuous ramped aging process is illustrated. After the preparing step (110), the initial aging step is completed by slowly ramping up the temperature of the alloy from room temperature to $T_1$, which is a temperature of at least 250° F. Next, the aging temperature is ramped down slowly through the range of the final aging temperature $T_F$, which is the range of 150 to 225° F.

Figure 1F:
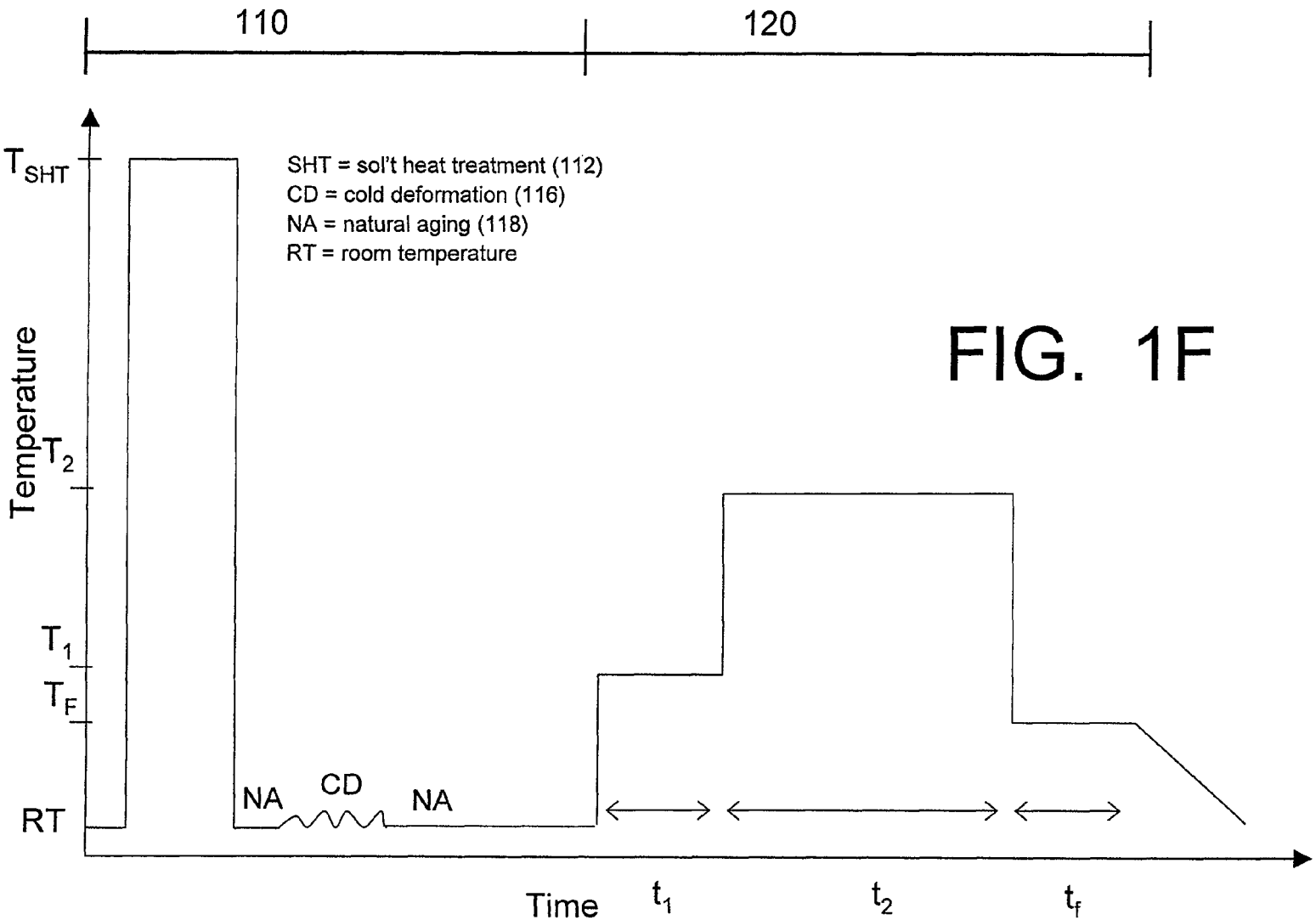
FIG. 1F is a chart illustrating one embodiment of a method for producing a new alloy.
Figure 2:
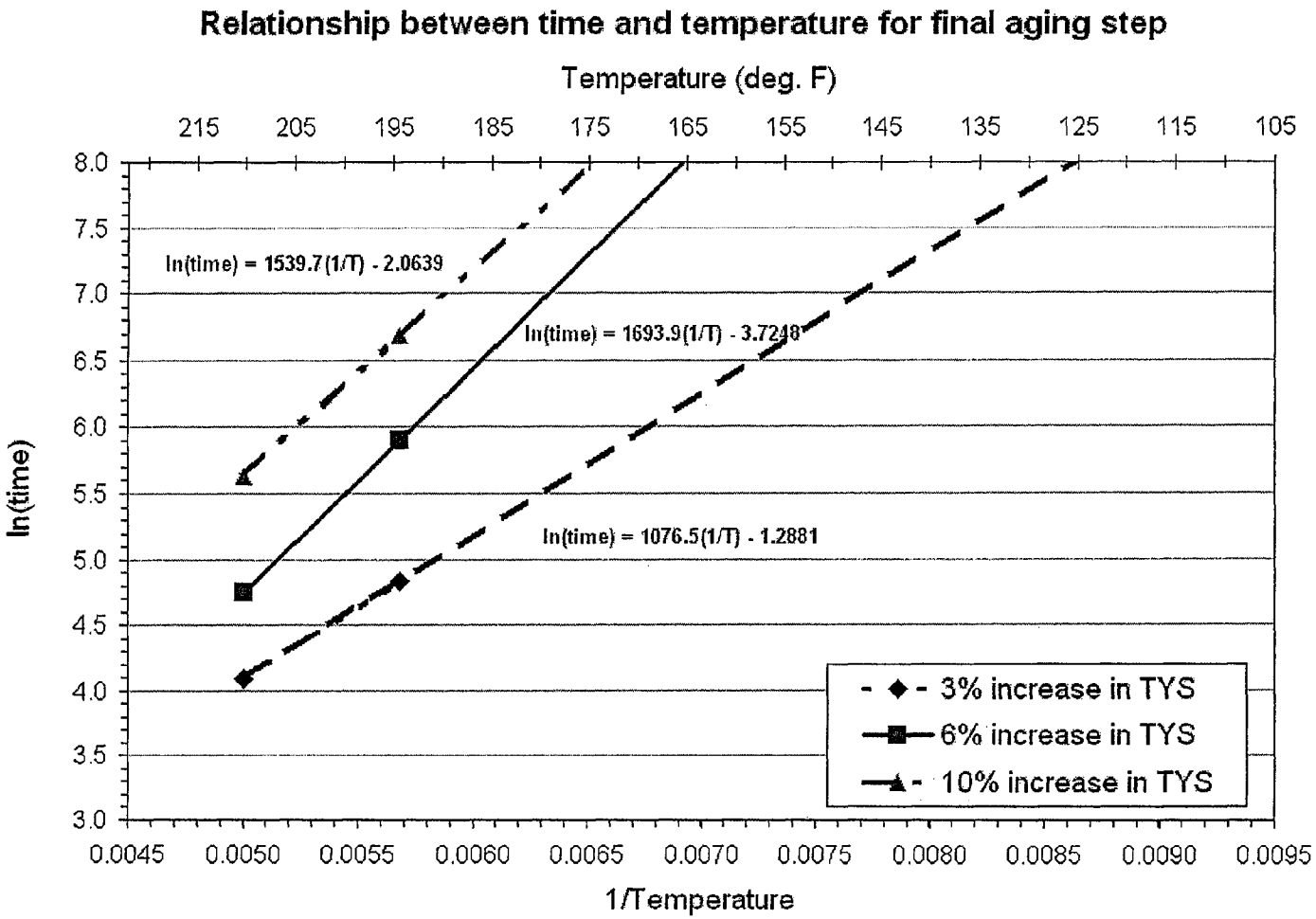
FIG. 2 is a chart illustrating three examples of an Arrhenius relationship between time and temperature relative to a final aging step of the present disclosure.

Referring now to FIG. 1F, a three-step, stepped aging process is illustrated. After the preparing step (110), the initial aging step is completed by stepping up the temperature of the alloy from room temperature to $T_1$, which is a temperature below 250° F. The alloy is then held at $T_1$ for time $t_1$. The duration of time $t_1$ is alloy dependent, but generally is in the range of 5 to 24 hours in this embodiment. Next, the alloy is stepped up to temperature $T_2$, which is a temperature of at least 250° F. and is greater than temperature $T_1$. The alloy is then held at $T_2$ for time $t_2$. The duration of time $t_2$ is alloy dependent, but generally is in the range of 20 to 48 hours in this embodiment. Next, the aging temperature is stepped down to the final aging temperature $T_F$, which is a temperature in the range of 150 to 225° F. The alloy is then held at $T_F$ for time $t_f$. The duration of time $t_f$ is alloy dependent, but generally is in the range of 20 to 5000 hours in this embodiment. The alloy is then allowed to cool to room temperature.

Variations of the above-described methods may be employed to produce the new alloys disclosed herein. For example, in some embodiments, combinations of stepped, ramped, and/or continuous ramped may be employed to produce alloys having the strength and fatigue crack growth resistant properties described herein.

In one embodiment, at least one of the aging steps is isothermal. In this embodiment, the temperature of the system stays essentially constant during that aging step (e.g., the final aging step).

In one embodiment, at least one of the aging steps has a temperature range within which aging occurs is defined by an Arrhenius equation (e.g., the final aging step). As described above an "Arrhenius equation" or "Arrhenius relationship" is a mathematical description of a given property which changes as a function of temperature due to the property being based on a thermally activated process. An Arrhenius equation can be derived for any given alloy if a few time and temperature points are known. For example, FIG. 3 demonstrates several Arrhenius relationships defined by the equations ln (natural log)(time)=x(1/T)−y; where:

a. (time) is cumulative time of final aging;

b. ln is a natural logarithm;

c. T is the temperature at a given cumulative time of final aging;

d. x is a constant; and e. y is a constant.

In another embodiment, the time needed to achieve the final aging results of the instant invention is inversely proportional to the temperature of the final aging step.

As described above, the new alloys realize an improved combination of properties. In one embodiment, the improved properties include an improvement in strength with at least equal fatigue crack growth performance. In some embodiments, the improved properties include an improvement in both strength and fatigue crack growth performance. In other embodiments, the improved properties include an improvement in fatigue crack growth performance with at least equal strength.

In one approach, the first wrought aluminum alloy may realize (1) at least a 3% or 6% increase in tensile yield strength as compared to a similar wrought aluminum alloy; and (2) at least equal fatigue crack growth resistance as compared to the similar wrought alloy. In some embodiments, the increase in strength is at least 8%, or at least 10%, or even at least 12%, with at least equal fatigue crack growth performance.

In some embodiments, the wrought aluminum alloy is a first plate product, and the crack growth rate (da/dN) of the first plate product is at least 5% lower than the similar plate product at equivalent ΔK. In one embodiment, da/dN of the first plate product is at least 15% lower than the similar plate product at equivalent ΔK. In one embodiment, da/dN of the first plate product is at least 25% lower than the similar plate product at equivalent ΔK. In one embodiment, da/dN of the first plate product is at least 50% lower than the similar plate product at equivalent ΔK. In one embodiment, the first plate product realizes at least a 1% increase in spectrum flights between a half crack length of 25 mm (0.98 inch) and 65 mm (2.56 inches) as compared to the similar plate product. In one embodiment, the first plate product realizes at least a 5% increase in spectrum flights over this half crack length as compared to the similar plate product. In one embodiment, the first plate product realizes at least a 10% increase in spectrum flights over this half crack length as compared to the similar plate product. In one embodiment, the first plate product realizes at least a 25% increase in spectrum flights over this half crack length as compared to the similar plate product. In one embodiment, the first plate product realizes at least a 50% increase in spectrum flights over this half crack length as compared to the similar plate product.

In other embodiments, the wrought aluminum alloy is a first sheet product, and the CAFCGR is at least equal L-T CAFCGR or T-L CAFCGR as compared to the similar sheet product, and generally when the CAFCGR is measured at a ΔK in the range of 10-45 MPa√m. In one embodiment, the ΔK is at least 25 MPa√m, and/or in the range of 25-45 MPa√m.

Improved strength and/or fatigue crack growth performance may also be realized with other wrought products, such as extrusions or forgings.

Example 1

Figure 3:
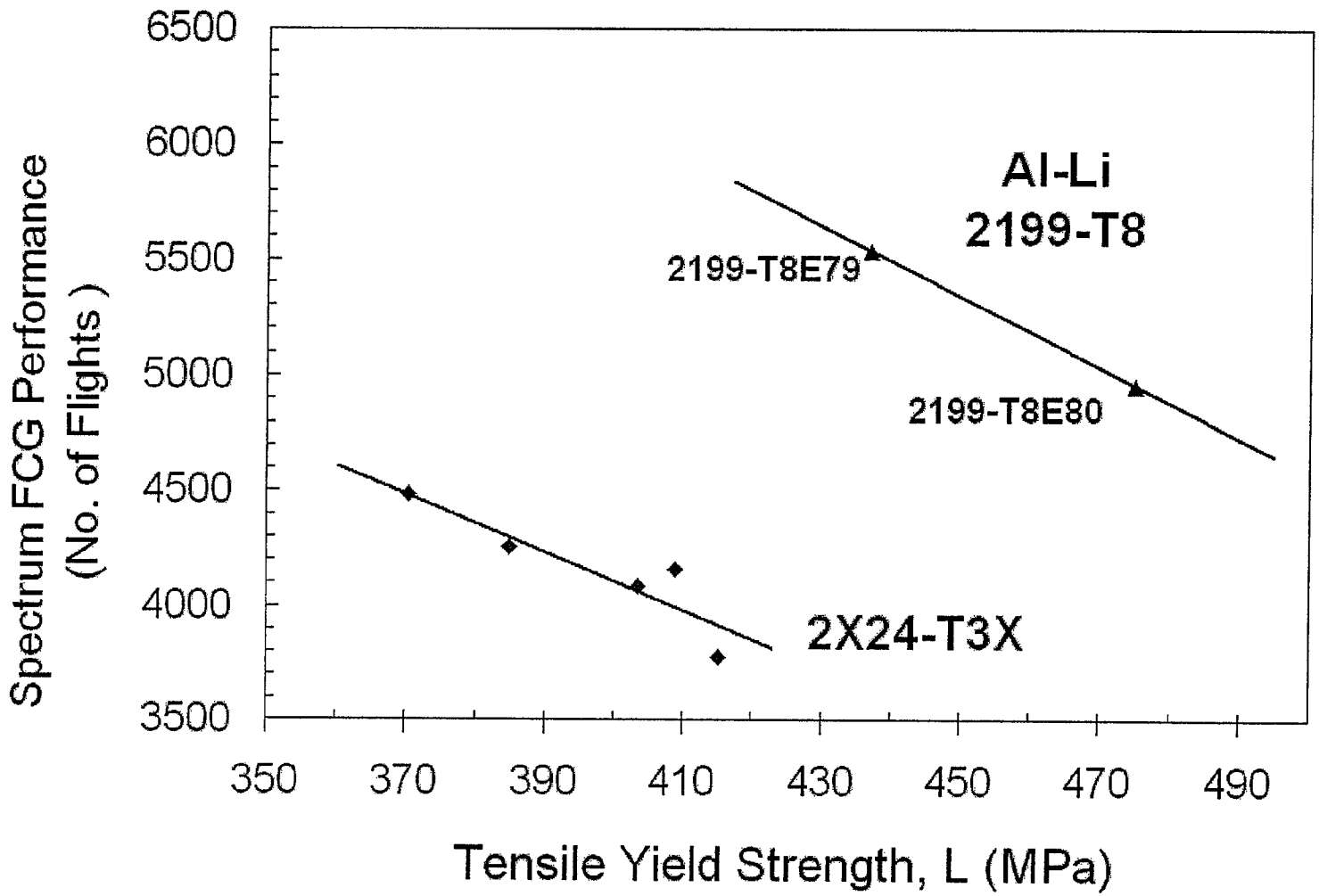
FIG. 3 is a graph illustrating strength versus spectrum fatigue crack growth performance for various alloys produced in accordance with conventional practices.

Prior Art 2Xxx Alloys (with and without Li) Produced Using Conventional (Standard) Aging Process—Spectrum Fatigue Crack Growth Performance AA2x24-T3 plate is tempered by cold deformation and natural aging and AA2199-T8 is tempered by cold deformation and artificially aged using a conventional multi-step aging process to obtain various strengths. The yield strength of the alloys is measured in accordance with ASTM B557-06, and the spectrum fatigue crack growth performance of each alloy is measured in accordance with aircraft manufacturer specifications. As illustrated in FIG. 3, with increasing yield strength the alloys realize lower spectrum fatigue crack growth resistance.

Example 2

2xxx+Li Alloys Produced Using New Multi-Step Aging Processes—Spectrum Fatigue Crack Growth Performance AA2199 is produced and rolled into plate. Seven samples of the AA2199 plate are subjected to a conventional multi-step aging practice. One sample is not further aged and is used as a control sample. The remaining six samples are subjected to a final aging step at various time and temperatures. The strength of each of the seven samples is measured in accordance with ASTM B557-06. The spectrum fatigue crack growth resistance of the seven samples is measured in accordance with an aircraft manufacture specification. From each of the seven samples, a center-cracked M(T) specimen in the L-T orientation having a width of 200 mm (7.87 in.) and thickness of 12 mm (0.47 in.) was machined along with a longitudinal tensile specimen having a diameter of 12.7 mm (0.5 in.). Prior to the application of the spectrum to the M(T) specimens, the specimens are fatigue pre-cracked under constant amplitude loading condition to a half crack length (a) of about 20 mm. Collection of crack growth data under spectrum loading starts at a half crack length of 25 mm to reduce the influence of transient effects resulting from the change from constant amplitude to spectrum loading conditions. The spectrum crack growth data is collected over the crack length interval of 25-65 mm, and crack length vs. number of simulated flights and number of flights to reach 65 mm are obtained. The test frequency is about 10 Hz, and the tests are performed in a moist air environment having a relative humidity of greater than 90%. The 0.2% offset tensile yield strength for each aging condition is measured in accordance with ASTM B557-06 using round specimens having a diameter of 0.50 inch.

Figure 4:
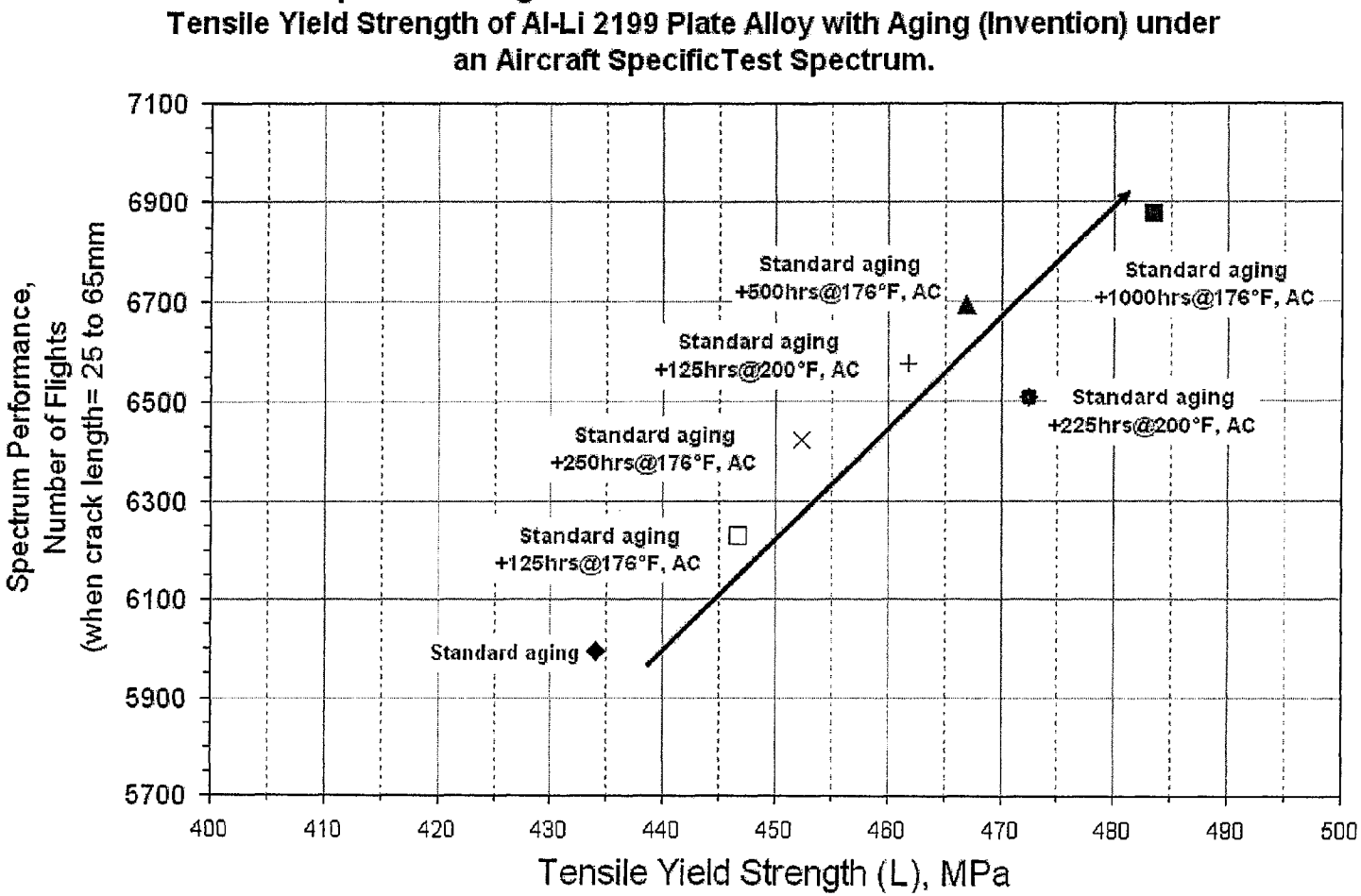
FIG. 4 is a graph illustrating strength versus spectrum fatigue crack growth performance for various alloys produced in accordance with both a conventional method and the new methods described herein.

As illustrated in FIG. 4, the alloys with the additional final aging step realize improved strength with at least equal spectrum fatigue crack growth resistance. In particular, the alloys with the additional final aging step realize improved spectrum fatigue crack growth performance when the final aging temperature is in the range of 176° F. to 200° F., and the final aging duration is in the range of 125-1000 hours.

Example 3

2xxx+Li Alloys Produced Using A New Multi-Step Aging Process—Spectrum Fatigue Crack Growth Performance AA2199 is produced and rolled into plate. Five samples of the AA2199 plate are aged to various strengths using conventional multi-step aging practices. From each of these samples, a portion of the alloy is removed and subjected to a final aging step of 176° F. for a duration of 500 hours. The strength of each of the five sample pairs is measured in accordance with ASTM B557-06. From each sample, two center-cracked M(T) specimens in the L-T orientation and two longitudinal tensile specimens are machined having the same dimensions as in Example 2. Spectrum fatigue crack growth resistance is measured utilizing a Mini-TWIST Spectrum, truncated at Level III, with mean flight stress of 67.6 MPa (9.8 ksi). With the exception of the spectrum used, the details of the test procedures and analysis are the same as those used in Example 2.

Figure 5:
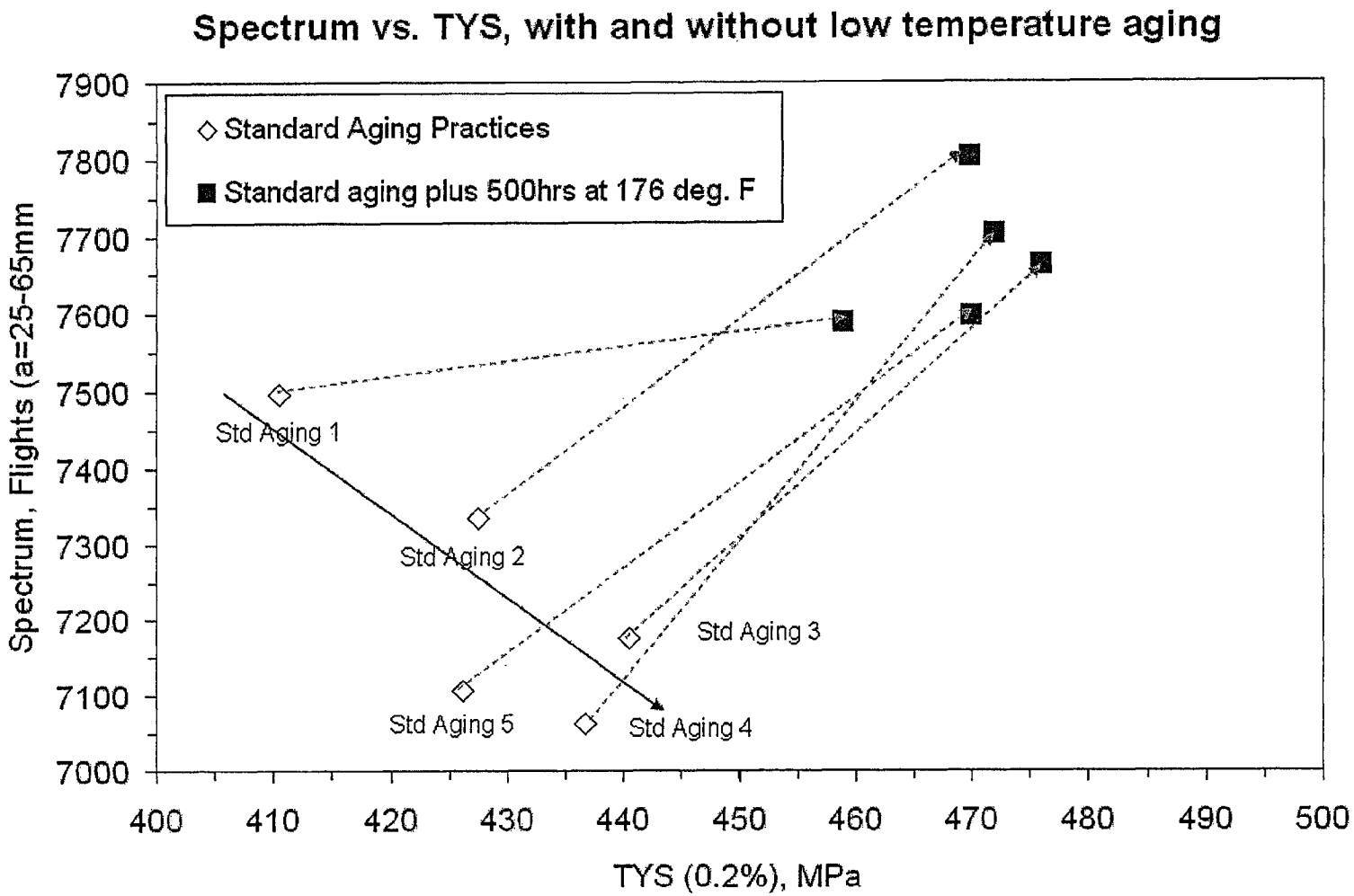
FIG. 5 is a graph illustrating strength versus spectrum fatigue crack growth performance for alloys produced in accordance with both a conventional method and the new methods described herein.

As illustrated in FIG. 5, the five conventionally aged samples (open diamonds) realize decreasing spectrum fatigue crack growth resistance with increasing strength. However, the alloys with the additional final aging step the multi-step aged alloys (filled squares) realize both increased strength and spectrum fatigue crack growth resistance relative to their conventionally aged counterparts.

Example 4

2xxx+Li Alloys Produced Using New Multi-Step Aging Processes—Spectrum Fatigue Crack Growth Performance AA2199 is produced and rolled into plate. Four samples of the AA2199 plate are aged using a conventional multi-step aging practice. One sample is not further aged and is used as a control sample. The remaining three samples are subjected to a final aging of 200° F. for 50 hours, 176° F. for 500 hours, and 225° F. for 25 hours, respectively. The strength of each of the four samples is measured in accordance with ASTM B557-06. From each sample, two center-cracked M(T) specimens in the L-T orientation and two longitudinal tensile specimens are machined having the same dimensions as in Example 2. Spectrum fatigue crack growth resistance is measured utilizing a Mini-TWIST Spectrum, truncated at Level III, with mean flight stress of 67.6 MPa (9.8 ksi). With the exception of the spectrum used, the details of the test procedures and analysis are the same as those used in Example 2.

Figure 6:
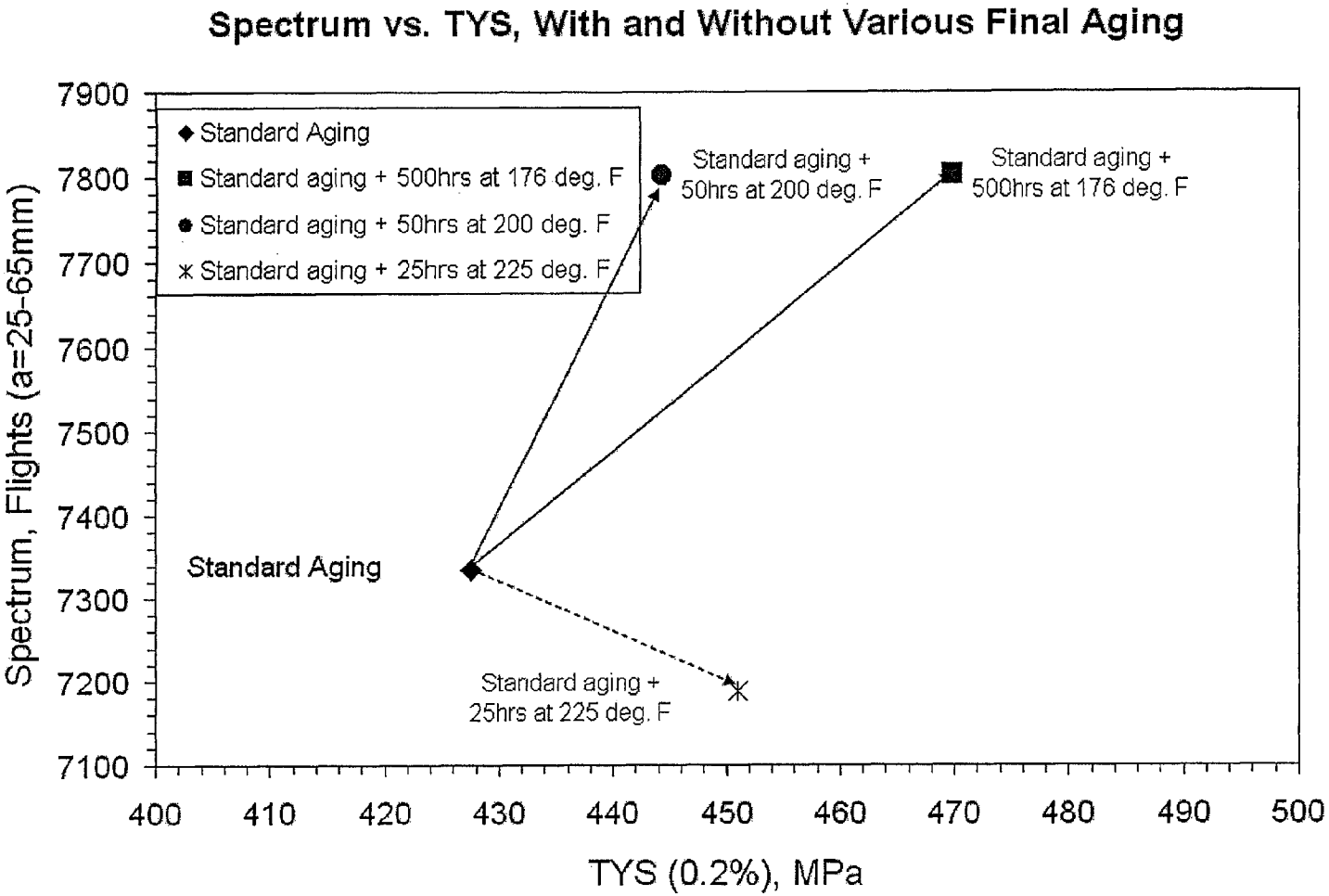
FIG. 6 is a graph illustrating strength versus spectrum fatigue crack growth performance for an alloy produced in accordance with both a conventional method and the new methods described herein.

As illustrated in FIG. 6, the two multi-step aged alloys having final aging temperatures of 176° F. and 200° F. and aging durations of 50 and 500 hours, respectively, realize improved strength and spectrum fatigue crack growth performance relative to the conventionally aged alloy. However, the multi-step aged alloy having a final aging temperature of 225° F. and an aging duration of 25 hours does not realize an improvement; instead this alloy realizes a decrease in spectrum fatigue crack growth performance with increasing strength, similar to that of the prior art alloys described in Example 1.

Example 5

Figure 7:
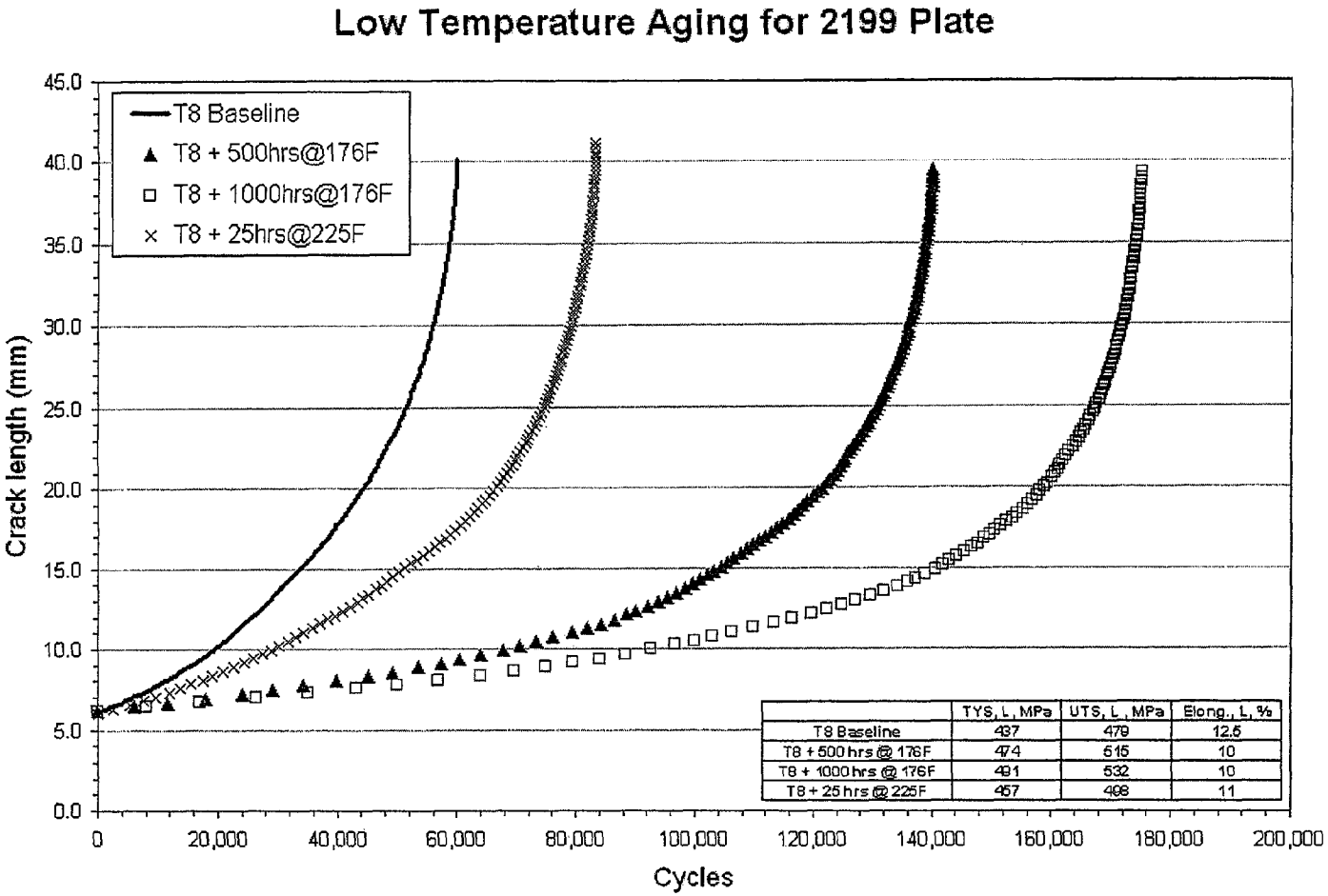
FIG. 7 is a graph illustrating constant amplitude fatigue crack growth performance for aluminum alloy plates produced in accordance with both a conventional method and the new methods described herein.

2xxx+Li Alloys Produced Using New Multi-Step Aging Processes—Constant Amplitude Fatigue Crack Growth Performance AA2199 is produced and rolled into plate. Four samples of the AA2199 plate are aged using a conventional multi-step aging practice. One sample is not further aged and is used as a control sample. The remaining three samples are subjected to a final aging of 200° F. for 50 hours, 176° F. for 500 hours, and 225° F. for 25 hours, respectively. The strength of each of the four samples is measured in accordance with ASTM B557-06. From each of the four samples, a center-cracked M(T) specimen in the L-T orientation and having a width of 101.6 mm (4 in.) and thickness of 6.34 mm (0.25 in.) is machined along with round tensile specimen having a diameter of 12.7 mm (0.50 in.). The constant amplitude fatigue crack growth resistance of the specimens is measured in accordance with ASTM E647-08. The minimum and maximum loads are kept constant at 61848 N (13904 $lb_f$) and 6183 N (1390 $lb_f$) throughout the test corresponding to a stress ratio of 0.1. The tests are performed at a frequency of 25 Hz in a moist air environment having a relative humidity of at least 90%. The specimens are fatigue pre-cracked to an initial crack length of 6 mm prior to the test. Crack length versus the number of load cycles is collected from a crack length of 6 mm to about 40 mm. As illustrated in FIG. 7, the constant amplitude fatigue crack growth resistance increases for all the alloys with the additional final aging step.

Figure 8:
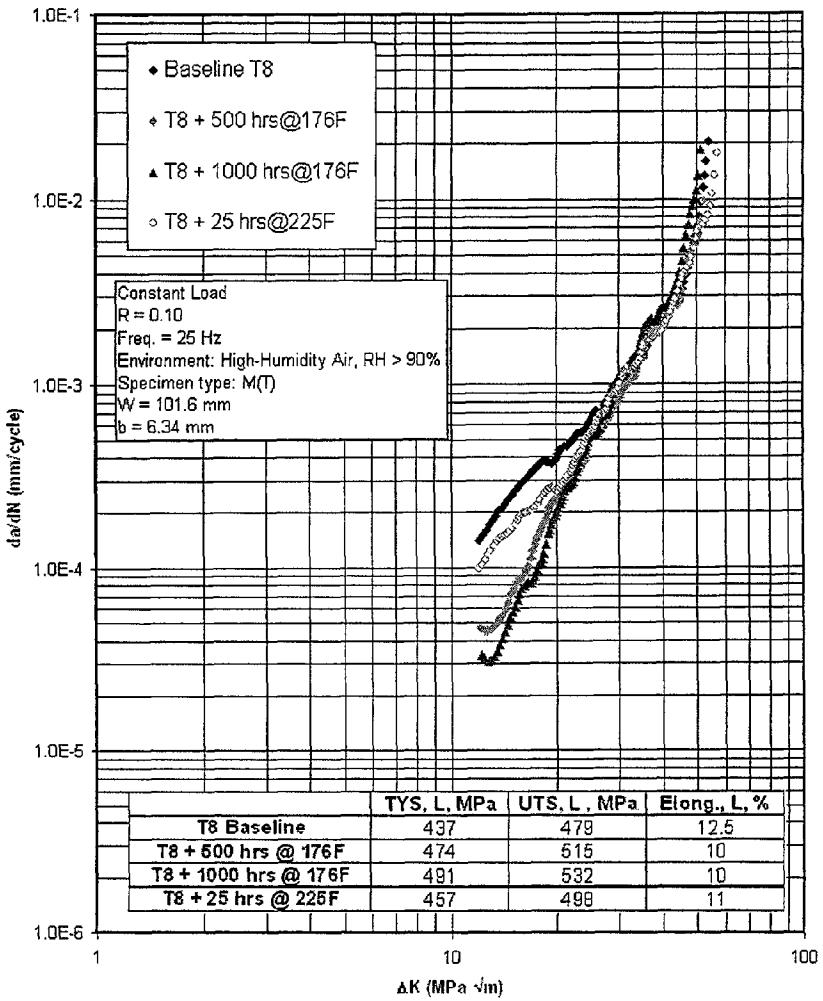
FIG. 8 is a graph illustrating constant amplitude fatigue crack growth rate (da/dN) as a function of ΔK for an aluminum alloy plates produced in accordance with both a conventional method and the new methods described herein.

The test data were further analyzed in accordance with ASTM E647-08 to obtain the fatigue crack growth rate (da/dN) as a function of the stress intensity factor range (ΔK). As illustrated in FIG. 8, the alloys with the additional final aging step realize improved crack growth rate at low to intermediate ΔK values (approximately 12-28 MPa√m). These improvements in fatigue crack growth resistance are realized even though the alloys also realize a marked strength improvement.

Example 6

Figure 9:
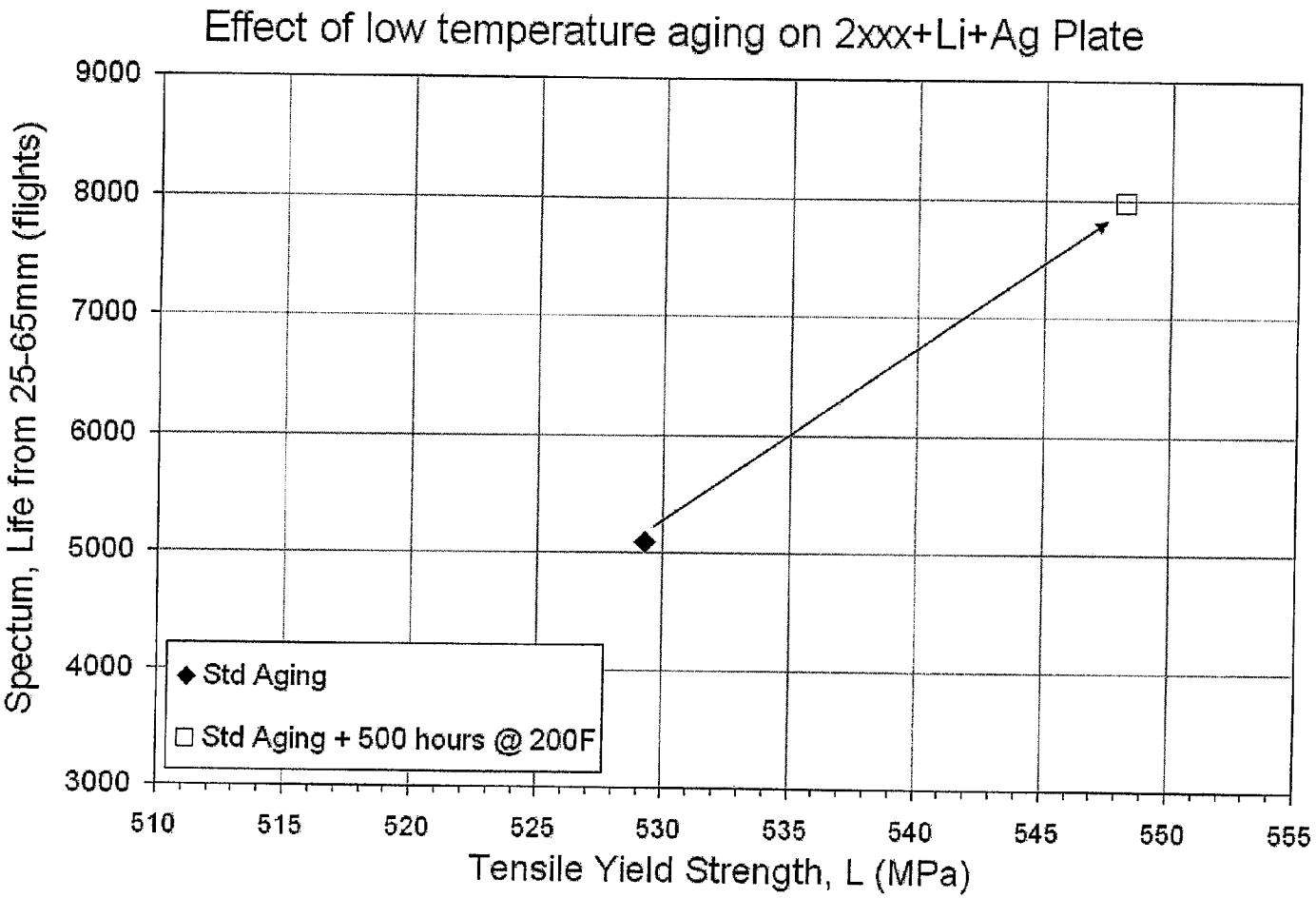
FIG. 9 is a graph illustrating strength versus spectrum fatigue crack growth performance for an alloy produced in accordance with both a conventional method and the new methods described herein.

2xxx+Li+Ag Alloys Produced Using a New Multi-Step Aging Process—Spectrum Fatigue Crack Growth Performance An aluminum-lithium plate having a composition similar to that of Alloy 10 from Table 2, above, is produced and rolled into plate. A sample of the plate is aged using a conventional multi-step aging practice. A portion of the sample is then removed and aged at 200° F. for 500 hours. The strength of each of the alloys is measured in accordance with ASTM B557-06. From each aging practice, a center-cracked M(T) specimen in the L-T orientation and two longitudinal tensile are machined having the same dimensions as in Example 2. Spectrum fatigue crack growth resistance is measured utilizing a Mini-TWIST Spectrum, truncated at Level III, with mean flight stress=67.6 MPa (9.8 ksi). With the exception of the spectrum used, the details of the test procedures and analysis are the same as those used in Example 2. As illustrated in FIG. 9, the alloy with the additional final aging step realizes both increased spectrum fatigue crack growth resistance and tensile yield strength.

Example 7

2xxx+Li Alloys Produced Using New Multi-Step Aging Processes—Constant Amplitude Fatigue Crack Growth Performance—Sheet AA2199 sheet is produced and rolled to sheet. The alloy is then aged using a conventional single-step aging practice. Two center-cracked M(T) specimens in the L-T orientation and two in the T-L orientation are machined from the sheet, each specimen having a width of 400 mm (15.7 inches). The sheet thickness and specimen thickness are 4 mm (0.157 inch). Four longitudinal and four long transverse tensile specimens are machined having the dimensions 4 mm (0.157 inch) thick and 12.7 mm (0.5 inch) wide. One M(T) specimen from each orientation and two tensile specimens of each orientation is subjected to a final aging step of 225° F. for 40 hours.

The tensile properties of the sheet are measured in accordance with ASTM B557-06. The constant amplitude fatigue crack growth resistance is measured in accordance with ASTM E647-08. The fatigue crack growth testing is performed at a stress ratio R=0.1 and the tests are run in lab air with a relative humidity of at least 20%. The testing is designed to simulate a constant load amplitude test with a maximum load of 120 MPa, R=0.1, and an initial crack length of 2a=4 mm. The testing uses a specimen compliance technique to measure crack length. A displacement gauge is used for compliance measurement. To overcome issues associated with accuracy at very short crack lengths, the tests are run with a controlled K gradient that utilizes a longer initial crack length. The initial crack length used is 2a=36 mm, the specimen width is 400 mm, and a K gradient control is used to control the rate of change in ΔK to match that achieved by a constant load amplitude test. The test frequency used is 8 Hz at the start of the test, and it is decreased to 4 Hz during the test.

Figure 10:
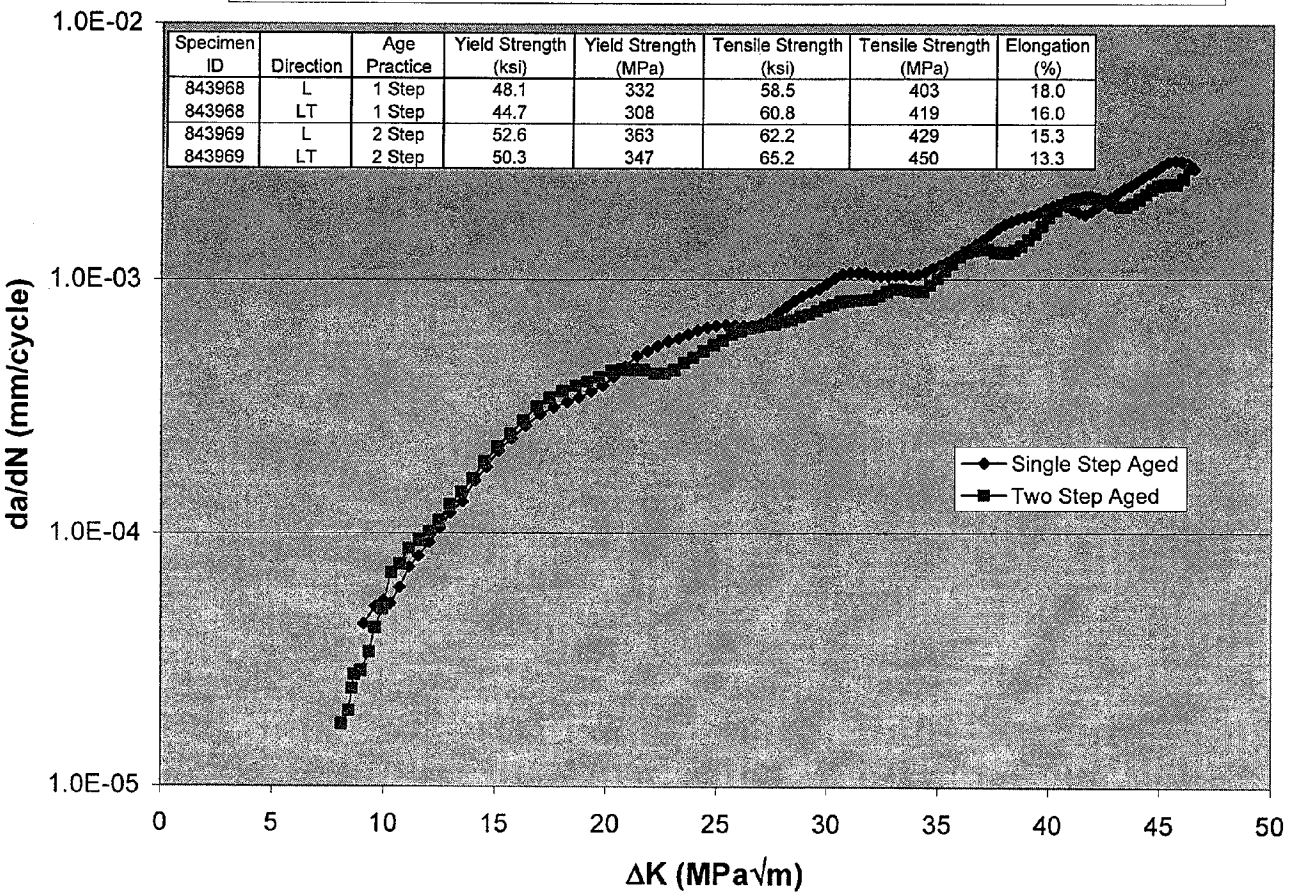
FIG. 10 is a graph illustrating T-L constant amplitude fatigue crack growth rate (da/dN) as a function of ΔK for an aluminum alloy sheet produced in accordance with both a conventional method and the new methods described herein.
Figure 11:
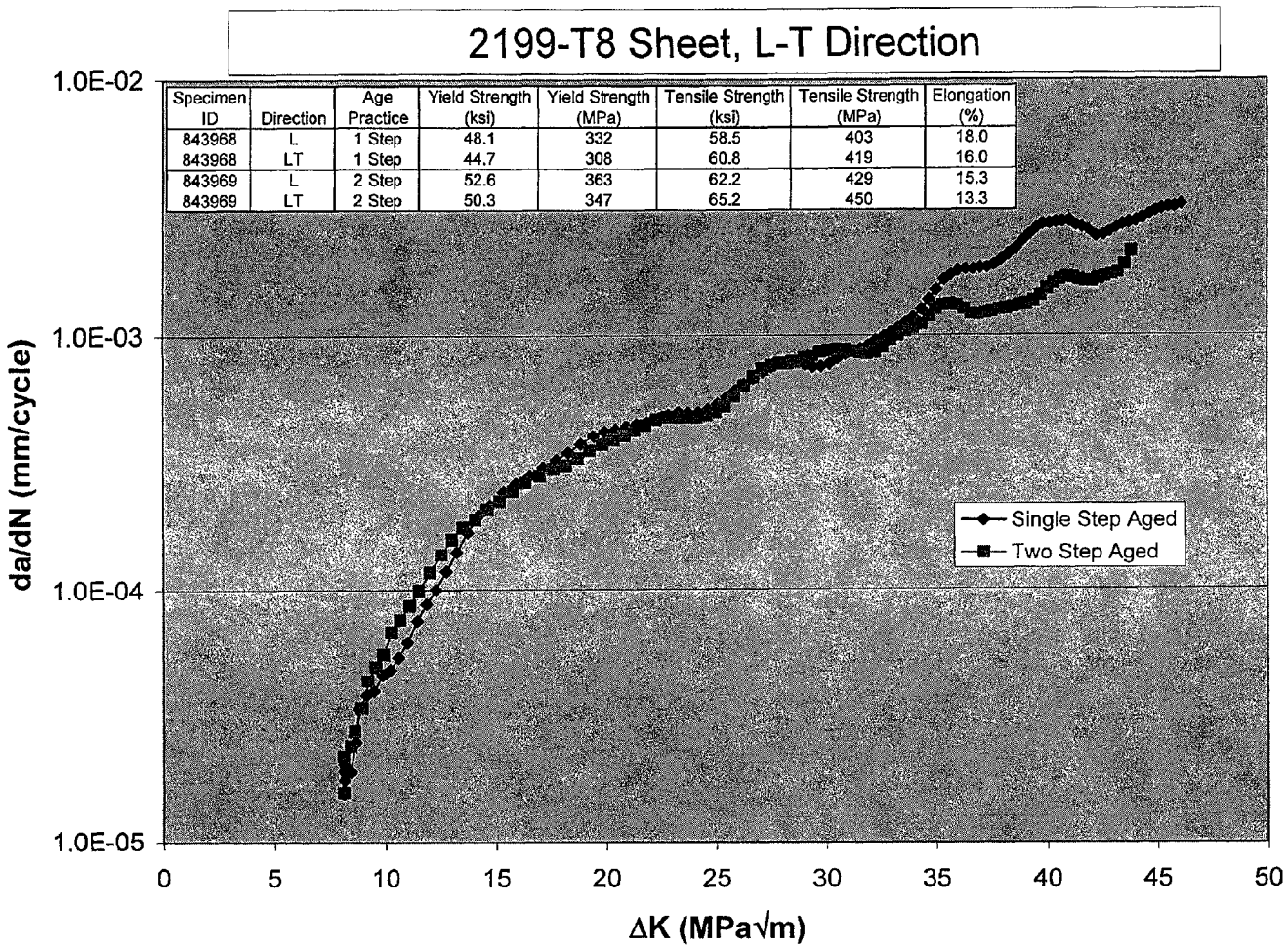
FIG. 11 is a graph illustrating L-T constant amplitude fatigue crack growth rate (da/dN) as a function of ΔK for an aluminum alloy sheet produced in accordance with both a conventional method and the new methods described herein.

As illustrated in FIG. 10 and FIG. 11, the alloy with the additional final aging step realizes increased strength in both the L and LT directions while also realizing at least equivalent L-T and T-L constant amplitude fatigue crack growth rate (da/dN) as a function of ΔK relative to the single-step aged alloy. In particular, the fatigue crack growth rate (da/dN) for the multi-step aged alloys is about the same as the single-step aged alloys for ΔK values in the range of 10 to 45 MPa√m. The magnitude of the strength increase is 9.4% for the L direction and 12.5% for the LT direction based on the average of duplicate tests.

Example 8

Microstructure of 2xxx+Li Alloys Produced Using New Multi-Step Aging Processes

AA2199, a conventional Al—Li alloy, is solution heat treated, quench, cold deformed, and artificially aged using both (i) a conventional two-step aging practice, the first step being 8 hours at about 225° F., and the final step being 28 hours at about 290° F., and (ii) an embodiment of the new aging practice disclose herein, the first step being 8 hours at about 225° F., the second step being 28 hours at about 290° F., and the final step being 2000 hours at 176° F.

Figure 12A:
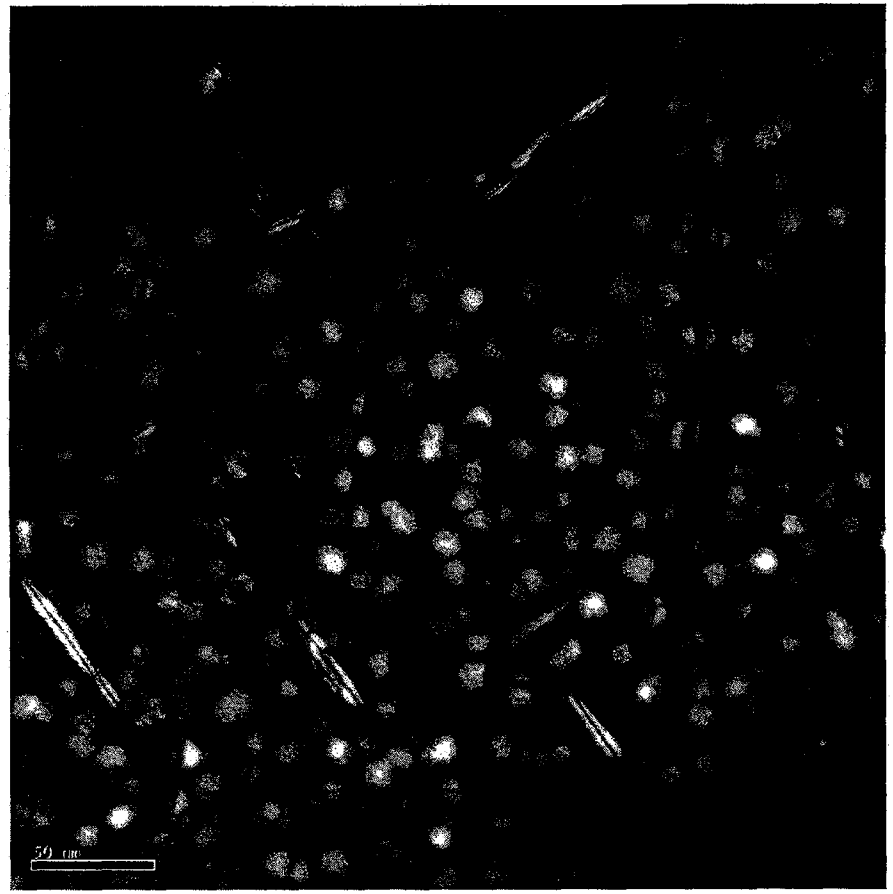
FIG. 12*a* is a TEM photo illustrating the microstructure of a conventionally processed alloy.
Figure 12B:
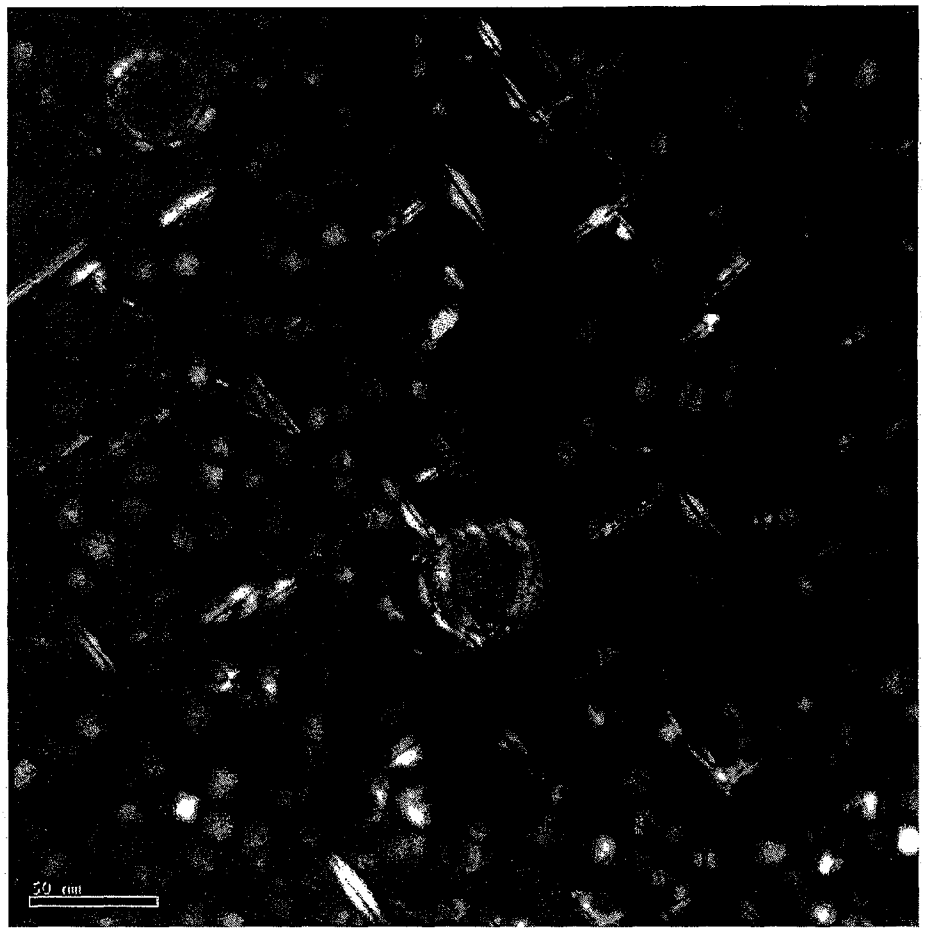
FIG. 12*b* is a TEM photo illustrating the microstructure of a conventionally processed alloy.
Figure 14:
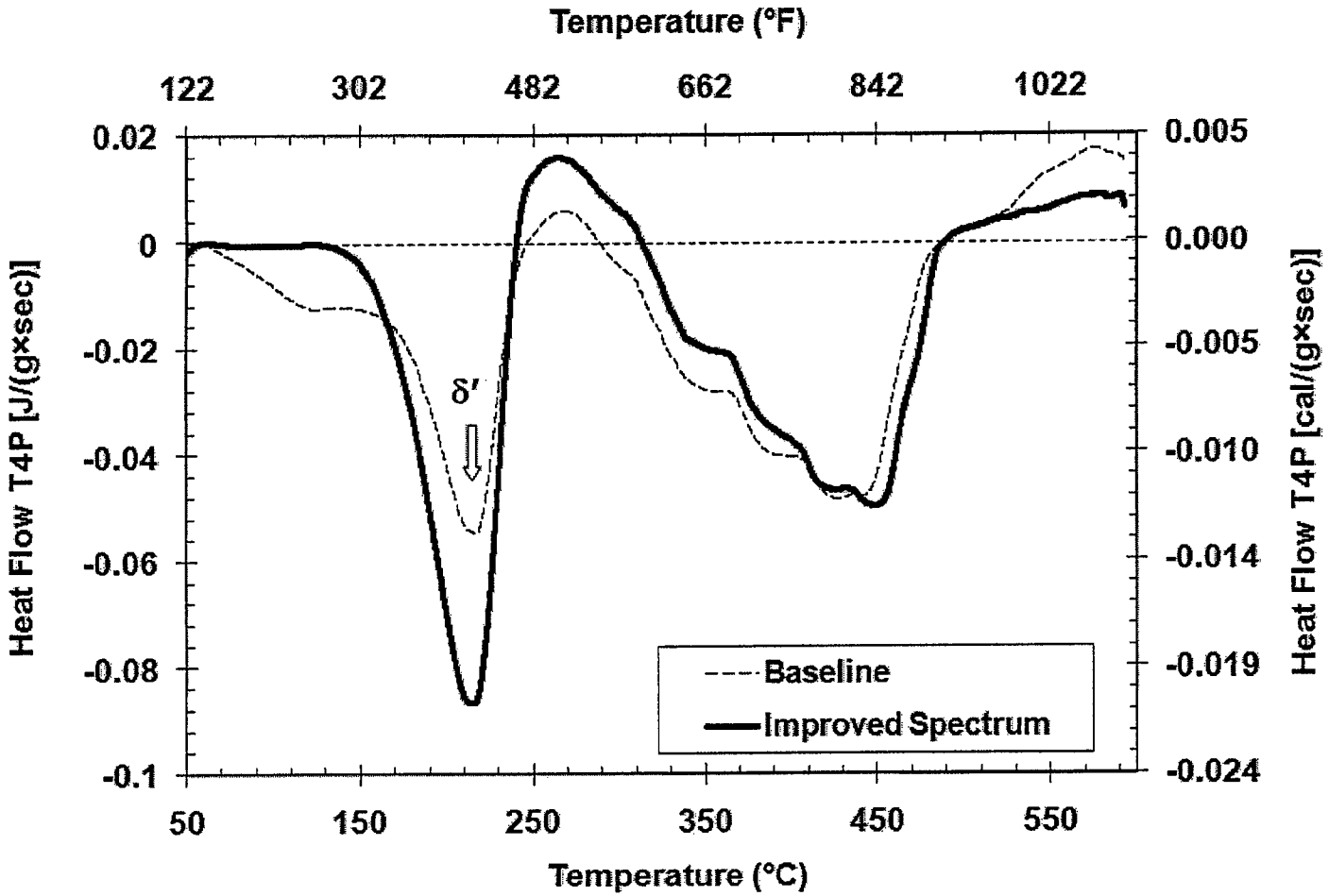
FIG. 14 is a Differential Scanning Calorimetry graph based on a conventionally processed alloy and an alloy processed with an embodiment of the new final aging step disclosed herein.

Both alloys are scanned using a Transmission Electron Microscope (TEM) with in-situ observation and Differential Scanning Calorimeter (DSC). The results of TEM and DSC measurements are illustrated in FIGS. 12*a*-12*b* (conventional alloy), 13*a*-13*b* (new alloy). The DSC results are illustrated in FIG. 14. DSC traces were plotted by fixing zero heat flow rate at 122° F. and 914° F.

Figure 13A:
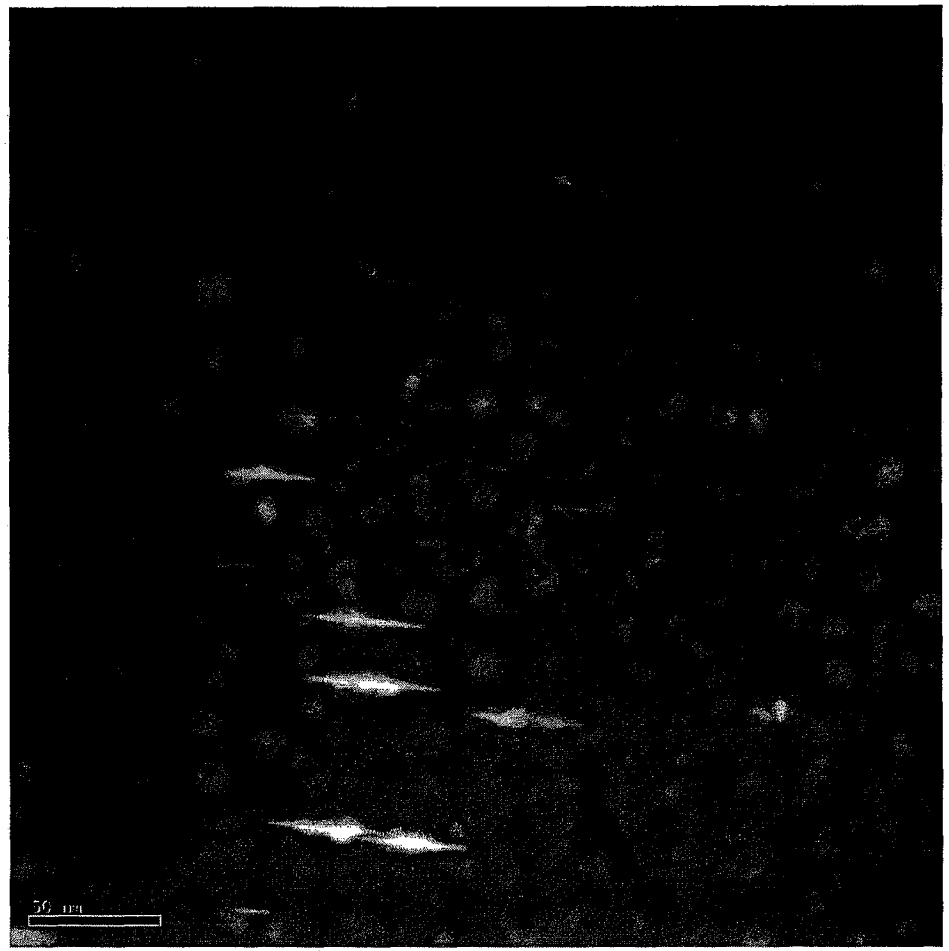
FIG. 13*a* is a TEM photo illustrating the microstructure of an alloy processed with an embodiment of the new final aging step disclosed herein.
Figure 13B:
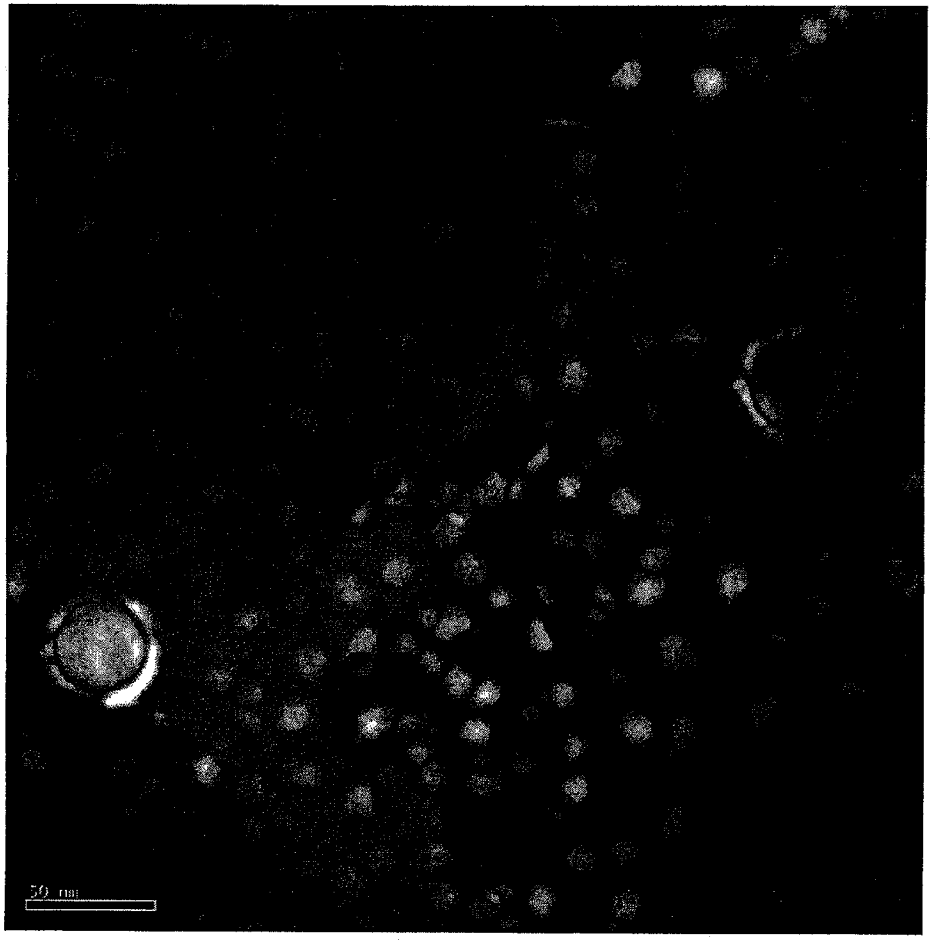
FIG. 13*b* is a TEM photo illustrating the microstructure of an alloy processed with an embodiment of the new final aging step disclosed herein.

Some microstructural changes were observed at high magnifications (over 50,000×) in the TEM as a result of the new aging process disclosed herein. As illustrated in FIGS. 12*a*-12*b* and 13*a*-13*b*, the δ' phase is imaged in dark field conditions. Normally, as illustrated in FIGS. 12*a*-12*b*, the δ' phase is spherical with some coating of the Θ' precipitates and $Al_3Zr$ dispersoids. As illustrated in FIGS. 13*a*-13*b*, the δ' phase coarsens both on the surface of δ' plate-like precipitates and the $Al_3Zr$ dispersoids. In addition the spherical δ' precipitates also appear to coarsen. Thus, the final aging disclosed herein appears to realize a new microstructure that may contribute to the alloy realizing increased strength while at least maintaining fatigue crack growth resistance.

FIG. 14 illustrates the DSC samples of the above alloys. "Baseline" is the conventionally processed AA2199, and "Improved Spectrum" is the AA2199 processed in accordance with the new aging practice disclosed above. As illustrated in FIG. 14, the endothermic reaction due to the dissolution of δ' is larger for the sample with the additional lower temperature aging step. There is a higher volume fraction of δ' for the newly processed alloy relative to the conventional alloy. The coarsening reactions of δ' may be responsible for provide an increase in strength without impairing fatigue performance. Other changes to the precipitation reactions at grain boundaries could be present but these were not examined in this example in detail.

While a number of embodiments of the present disclosure have been described in detail, these are illustrative embodiments only, and not restrictive, and that many modifications and/or alternative embodiments may become apparent to those of ordinary skill in the art. Furthermore, the appended claims are intended to cover all such ordinary modifications and embodiments that come within the spirit and scope of the present disclosure.

What is claimed is:

1. A method comprising:

(i) preparing a 2199 aluminum alloy for artificial aging, the preparing comprising:

a. solution heat treating the 2199 aluminum alloy at a temperature of at least 800° F.; and b. quenching the 2199 aluminum alloy; and (ii) artificially aging the 2199 aluminum alloy, the artificial aging comprising:

c. aging the 2199 aluminum alloy at a temperature of at least 250° F.; and d. final aging the 2199 aluminum alloy at a temperature of from 165° to not greater than 225° F. and for a duration such that the 2199 aluminum alloy realizes:

(1) at least a 3% increase in tensile yield strength as compared to a similar aluminum alloy; and (2) better fatigue crack growth resistance as compared to the similar aluminum alloy;

wherein the artificial aging step (ii) is completed such that the volume fraction of delta prime phase within the 2199 aluminum alloy increases during the final aging step, and wherein the claimed tensile yield strength increase and better fatigue crack growth resistance properties are realized due to such increase in the volume fraction of the delta prime phase;

wherein the similar aluminum alloy is of identical composition relative to the 2199 aluminum alloy;

wherein the similar aluminum alloy and the 2199 aluminum alloy are prepared identically for artificial aging; and wherein the similar aluminum alloy is artificially aged in the same manner as the first 2199 aluminum alloy, but in the absence of the final aging step (ii)(d).

2. The method of claim 1, wherein the artificially aging step (ii) comprises:

second aging the 2199 aluminum alloy at a temperature in the range of from 250° F. to 330° F., wherein the second aging occurs after the aging step (ii)(c) and before the final aging step (ii)(d).

3. The method of claim 1, wherein the final aging step (ii)(d) is completed at a temperature that is lower than any previous artificial aging step.

4. The method of claim 1, wherein the final aging step (ii)(d) occurs at a temperature of at least 175° F.

5. The method of claim 1, wherein the duration of the final aging step (ii)(d) is not greater than 1,000 hours.

6. The method of claim 1, wherein the duration of the final aging step (ii)(d) is not greater than 500 hours.

7. The method of claim 1, wherein the duration of the final aging step (ii)(d) is not greater than 150 hours.

8. The method of claim 1, wherein the 2199 aluminum alloy is a first plate product, wherein the similar aluminum alloy is a similar plate product, wherein the fatigue crack growth resistance is constant amplitude fatigue crack growth resistance (CAFCGR), and wherein the first plate product exhibits:

(1) at least a 3% increase in tensile yield strength as compared to the similar plate product; and (2) better CAFCGR as compared to the similar plate product, wherein the CAFCGR is measured at a $\Delta K$ in the range of from 11 MPa√m to 30 MPa√m.

9. The method of claim 8, wherein the $\Delta K$ is not greater than 25 MPa√m.

10. The method of claim 9, wherein the first plate product has a crack growth rate (da/dN) that is at least 5% lower than the similar plate product at an equivalent AK.

11. The method of claim 1, wherein the 2199 aluminum alloy is a first plate product, wherein the similar aluminum alloy is a similar plate product, wherein the fatigue crack growth is spectrum fatigue crack growth resistance (SFCGR), and wherein the first plate product exhibits:

(1) at least a 3% increase in tensile yield strength when compared to a similar plate product; and (2) better SFCGR when compared to the similar plate product.

12. The method of claim 11, wherein the first plate product realizes at least a 1% increase in spectrum flights between a half crack length of 25 mm (0.98 inch) and 65 mm (2.56 inches) as compared to the similar plate product.

13. The method of claim 1, wherein the 2199 aluminum alloy is a first sheet product, wherein the similar aluminum alloy is a similar sheet product, wherein the fatigue crack growth is constant amplitude fatigue crack growth resistance (CAFCGR), and wherein the first sheet product exhibits:

(1) at least a 3% increase in tensile yield strength as compared to the similar sheet product; and (2) at least one of:

(A) better L-T CAFCGR as compared to the similar sheet product and at a $\Delta K$ in the range of from 10 MPa√m to 45 MPa√m; and (B) better T-L CAFCGR as compared to the similar sheet product and at a $\Delta K$ in the range of from 10 to 45 MPa√m.

14. The method of claim 13, wherein the $\Delta K$ is not greater than 25 MPa√m.

* * * * *

UNITED STATES PATENT AND TRADEMARK OFFICE

CERTIFICATE OF CORRECTION

PATENT NO. : 8,333,853 B2
APPLICATION NO. : 12/355515
DATED : December 18, 2012
INVENTOR(S) : Giummarra et al.

It is certified that error appears in the above-identified patent and that said Letters Patent is hereby corrected as shown below:

In the Claims

Column 19, line 44, claim 1: replace "first 2199" with --2199--.

Signed and Sealed this
Twenty-sixth Day of November, 2013

Margaret A. Focarino

Margaret A. Focarino
*Commissioner for Patents of the United States Patent and Trademark Office*